US006649332B2

(12) United States Patent
Southby et al.

(10) Patent No.: US 6,649,332 B2
(45) Date of Patent: Nov. 18, 2003

(54) COLOR PHOTOGRAPHIC ELEMENT HAVING IMPROVED CONTRAST AND COMPATIBILITY WITH BOTH DRY AND CONVENTIONAL PROCESSING

(75) Inventors: David T. Southby, Rochester, NY (US); Xiqiang Yang, Webster, NY (US); Benjamin P. Hoag, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/135,752

(22) Filed: Apr. 30, 2002

(65) Prior Publication Data

US 2002/0177086 A1 Nov. 28, 2002

Related U.S. Application Data

(62) Division of application No. 09/746,050, filed on Dec. 21, 2000, now Pat. No. 6,440,648.
(60) Provisional application No. 60/211,460, filed on Jun. 13, 2000.

(51) Int. Cl.[7] ..... G03C 7/30
(52) U.S. Cl. ..... 430/496
(58) Field of Search ..... 430/496

(56) References Cited

U.S. PATENT DOCUMENTS

| | | | | |
|---|---|---|---|---|
| 3,877,940 | A | 4/1975 | Ericson | 430/428 |
| 4,255,510 | A | 3/1981 | Simons et al. | 430/219 |
| 4,256,881 | A | 3/1981 | Simons et al. | 544/132 |
| 5,354,650 | A | 10/1994 | Southby et al. | 430/544 |

FOREIGN PATENT DOCUMENTS

| | | |
|---|---|---|
| EP | 0 762 201 | 3/1997 |

OTHER PUBLICATIONS

Patent Abstracts of Japan, vol. 2000, No. 03, Mar. 30, 2000 & JP 11 352647 A (Fuji Photo).

Research Disclosure No. 13118, *Research Disclosure,* vol. 131, Mar. 1975.

Research Disclosure No. 17029, *Research Disclosure,* vol. 170, Jun. 1978.

*Primary Examiner*—Hoa Van Le
(74) *Attorney, Agent, or Firm*—Sarah Meeks Roberts

(57) ABSTRACT

A method of processing an imagewise exposed color photographic film, said film having at least three light-sensitive units which have their individual sensitivities in different wavelength regions, each of the units comprising at least one light sensitive silver halide emulsion and image dye coupler, which method comprises contacting the imagewise exposed color photographic film with an aqueous solution containing a non-blocked developing agent, at a temperature of between 30 to 60° C.; and wherein said film further comprises an incorporated reducing agent, at least one organic silver salt and an amido compound wherein the reducing agent is substantially unreactive in the aqueous color development step described above, but wherein color development of the same imagewise exposed film is capable of being alternatively obtained, without any externally applied developing agent, by heating said film to a temperature above about 80° C. essentially in the absence of aqueous solutions, such that the incorporated reducing agent reacts to form dye by reacting with the image dye couplers; with the proviso that the amido compound effectively reduces contrast when the film is heated above 80° C. but does not substantially reduce contrast when the film is processed by contacting the imagewise exposed color photographic film with a non-blocked developing agent under aqueous conditions, at a temperature of between 30 to 60° C.

8 Claims, 2 Drawing Sheets

COLOR PHOTOGRAPHIC ELEMENT HAVING IMPROVED CONTRAST AND COMPATIBILITY WITH BOTH DRY AND CONVENTIONAL PROCESSING

CROSS REFERENCE TO RELATED APPLICATIONS

This is a Divisional of U.S. application Ser. No. 09/746,050 filed Dec. 21, 2000 and now U.S. Pat. No. 6,440,648 which is a Provisional of U.S. application Ser. No. 60/211,460 filed Jun. 13, 2000.

FIELD OF THE INVENTION

This invention relates to a silver halide film that, after imagewise exposure, is capable of being color developed either (1) in a wet-chemical multi-tank process at a temperature of 60° C. or less by immersion in a phenylenediamine-containing developer solution or its equivalent, followed by desilvering in one or more subsequent solutions, or alternatively, (2) by thermal treatment of the film. This invention further relates to a silver halide film containing a blocked inhibitor which is an amido compound, said amido compound improving contrast when the film is thermally processed.

BACKGROUND OF THE INVENTION

With the remarkable advances in the fields of solid-state imaging devices and various hard-copy printing technologies made in recent years, both electronic imaging systems and silver-halide photographic systems have become available to the consumer. At the present time, silver halide photographic systems tend to be superior with respect to high sensitivity and high image quality. One particular shortcoming of the silver-halide system, however, in comparison to electronic imaging systems is that the photographic element requires a so-called wet-development process that typically requires substantial volumes of processing solutions. Thus, the development of a "dry" process for a silver-halide color photographic system has been a goal of the photographic industry for many years.

A dry development process can be accomplished by the use of photothermographic elements such as described in Research Disclosure 17029 (Research Disclosure PT). Generally, in these kinds of systems, development occurs by reduction of silver ions in the photosensitive silver halide to metallic silver as in conventional non-thermal systems, but the developing agent is contained within the element, so that it is unnecessary to immerse the photographic element in an aqueous solution containing a developing agent. Research Disclosure PT discloses a type B photothermographic system, wherein the type B elements contain in reactive association a binder, a photosensitive silver halide (prepared in situ or ex situ) and an oxidation-reduction image forming combination comprising (1) a metallic salt or complex of an organic compound as an oxidizing agent, and (2) an organic reducing agent or developing agent. "Dry processing" can also be accomplished by the use of diffusion transfer elements, see, for example EP 0762 201 (Matsumoto). One problem with such "dry" systems has been to achieve a commercially viable system that produces a quality of image comparable, in the eyes of the average film consumer, to traditional silver-halide film.

A practical color photothermographic system for general use with respect to consumer cameras would have significant advantages. Such film would be amenable to development at kiosks using dry equipment. A consumer could bring an imagewise exposed photothermographic film to a kiosk located at any one of a number of diverse locations, optionally independent from a wet-development lab, where the film could be developed and printed without any manipulation by third-party technicians. A consumer might also be more prone to owning and operating film development equipment at home if it was a dry system. Thus, the development of a successful photothermographic system could open up new opportunities for greater convenience and speed of film processing for a wider cross-section of consumers.

At this time thermal processors are not as available as are conventional aqueous processors, such as Kodak C-41 processors, which are widely available as a mature industry standard. The unavailability of thermal processors and associated equipment can hinder the adoption of dry photothermographic films by the consumer. Photothermographic films that could also be processed by Kodak C-41 chemistry or the like would overcome this disadvantage. Photothermographic films with such backwards compatibility would permit the consumer to enjoy the benefits unique to thermal processing (kiosk processing, low environmental impact, etc.) when thermal processing is accessible, and would also allow the consumer to take advantage of the current ubiquity of C-41 processing when thermal processing may not be accessible. However, differences in the requirements of films which are thermally processed vs. films which are wet processed make it difficult to provide one film which may be processed in two different ways.

In order to be acceptable for commercial application, it is necessary that a photothermographic system be stable before exposure, while avoiding desensitizing of the silver halide during storage. If these factors are not present the system may have increased fog and/or decreased Dmax after development. At the same time, the system must have sufficiently fast kinetics (including unblocking of the developing agent) when the exposed film is being developed by thermal activation. For a backwards compatible film, the requirement might be that the components in the photothermographic film, designed exclusively for the dry photothermographic development (for example the blocked developing agent and anti-fogging agents) do not adversely affect or interfere with the sensitometry of the film when it is developed by traditional wet-processing.

In photothermographic film systems used to capture full color images, once the film has been developed the scanning of the scene luminance content is only possible over a limited density range, determined by the scanner design. If the film densities are too high, scanning is either not possible or becomes subject to signal to noise problems and scene information is lost. It is essential to design color photothermographic films to have sufficient latitude; that is, to be capable of recording all required scene luminance information in a density range that can be scanned. Therefore, such film designs must have a lower gamma and so reach a lower maximum density in each color record than is normal for conventional films.

It is well known that certain heterocyclic molecules with relatively acidic hydrogen atoms bonded to a ring nitrogen or an adjacent sulfur atom act as development restrainers or inhibitors in photographic film and paper systems. Development inhibitors are utilized to either slow or stop development of silver halide grains. They can be used to correct unwanted dye absorption, improve sharpness and reduce granularity of films. Various methods have been described for chemically blocking these inhibitors so that they are stable to storage in the film but can be released in a timely fashion upon development. Release of inhibitor typically is achieved under aqueous alkaline conditions by reaction with base or other nucleophile in the processing solution. In particular, blocked inhibitors have found use in image transfer systems. *Research Disclosure* article 13118, March 1975 and U.S. Pat. Nos. 4,255,510 and 4,256,881 describe materials that use alkali-hydrolyzable groups to block the inhibitors, specifically N-mono substituted and N,N-disubstituted amido groups. Other methods of non-imagewise release involve reaction of a suitably blocked inhibitor with base or other nucleophile in the processing solution, such as described in U.S. Pat. No. 5,354,650, are known but have not been found useful in photothermography.

In conventional photographic systems, such as color negative films, the addition of free inhibitors, even in small quantities, leads to loss of sensitivity. It is therefore useful to release inhibitors imagewise by chromogenic development using, for example, Development Inhibitor Releasing (DIR) couplers. DIR couplers are used to control film response to light by reducing photographic gamma in an imagewise fashion. However, in many cases DIR couplers are not effective gamma reducers in photothermographic systems. Therefore it is necessary that the photothermograhic system include other types of inhibitors which are effective gamma reducers.

What is needed is a backwards compatible film which has a low enough gamma to satisfy the wide latitude needs of a photothermographic system without adversely affecting sensitivity when the same film is wet processed.

SUMMARY OF THE INVENTION

This invention provides a method of processing an imagewise exposed color photographic film, said film having at least three light-sensitive units which have their individual sensitivities in different wavelength regions, each of the units comprising at least one light sensitive silver halide emulsion and an image dye coupler, which method comprises contacting the imagewise exposed color photographic film with an aqueous solution containing a non-blocked developing agent at a temperature of between 30 to 60° C.; and wherein said film further comprises an incorporated reducing agent, at least one organic silver salt and an amido compound of Formula I:

I

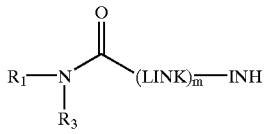

wherein INH is a development inhibitor;

LINK is a linking or timing group and m is 0, 1, or 2; and $R_1$ and $R_2$ independently are a hydrogen atom or an aliphatic, aromatic or heterocyclic group, or $R_1$ and $R_2$ together with the nitrogen to which they are attached represent the atoms necessary to form a 5- or 6-membered ring or multiple ring system, or $R_1$ and $R_2$ are independently a —C(=O)(LINK)$_m$—INH group, or are substituted with a —NR$_3$C(=O)—(LINK)$_m$—INH, with $R_3$ being defined the same as $R_1$ or $R_2$, with the proviso that only one of $R_1$ and $R_2$ can be a hydrogen atom;

wherein the reducing agent is substantially unreactive in the aqueous color development step described above, but wherein color development of the same imagewise exposed film is capable of being alternatively and comparatively obtained, without any externally applied developing agent, by heating said film to a temperature above about 80° C. essentially in the absence of aqueous solutions, such that the incorporated reducing agent reacts to form dye by reacting with the image dye couplers; with the proviso that the amido compound effectively reduces contrast when the film is heated above 80° C. but does not substantially reduce contrast when the film is processed by contacting the imagewise exposed color photographic film with a non-blocked developing agent under aqueous conditions, at a temperature of between 30 to 60° C.

This invention further provides a method of processing a commercial quantity of color photographic film sold to camera users over a given period of time, which film has been imagewise exposed in a camera, said film having at least three light-sensitive units which have their individual sensitivities in different wavelength regions, each of the units comprising at least one light sensitive silver halide emulsion, an image dye coupler and a blocked developing agent, wherein the method comprises:

(a) processing a first substantial portion of said quantity of film by a method comprising contacting the imagewise exposed color photographic film with an aqueous solution containing a non-blocked p-phenylenediamine developing agent, at a temperature of 30 to 60° C., in order to form image dye in the film by reaction of the non-blocked p-phenylenediamine developing agent with the image dye couplers contained in the light sensitive units, followed by desilvering said film in one or more desilvering solutions to remove unwanted silver and silver halide, thereby forming a color negative image; and (b) processing second substantial portion of said quantity of film by a method comprising heating said film to a temperature above about 80° C., without any externally applied developing agent, such that the blocked developing agent becomes unblocked to form a phenylenediamine developing agent, whereby the unblocked developing agent forms image dyes by reacting with the image dye couplers to form a color negative image; wherein the color photographic film further comprises at least one organic silver salt and an amido compound of Formula I:

I

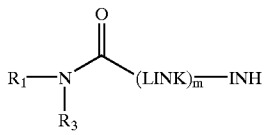

wherein INH is a development inhibitor;

LINK is a linking or timing group and m is 0, 1 or 2; and $R_1$ and $R_2$ independently are a hydrogen atom or an aliphatic, aromatic or heterocyclic group, or $R_1$ and $R_2$ together with the nitrogen to which they are attached represent the atoms necessary to form a 5- or 6-membered ring or multiple ring system, or $R_1$ and $R_2$ are independently a —C(=O)(LINK)$_m$—INH group, or are substituted with a —NR$_3$C(=O)—(LINK)$_m$—INH, with $R_3$ being defined the same as $R_1$ or $R_2$, with the proviso that only one of $R_1$ and $R_2$ can be a hydrogen atom;.

This invention also provides an article of manufacture comprising a packaged color photographic film which photographic film has at least three light-sensitive units which have their individual sensitivities in different wavelength regions, each of the units comprising at least one light-sensitive silver halide emulsion layer, an image dye-coupler, and a blocked phenylenediamine developing agent, wherein the film is enclosed by a package on which indicia indicates that the film may be processed by either a wet-chemical process or a thermal processing method; and wherein the film further comprises, at least one organic silver salt and an amido compound of Formula I:

I

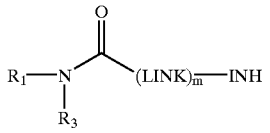

wherein INH is a development inhibitor;

LINK is a linking or timing group and m is 0, 1 or 2; and $R_1$ and $R_2$ independently are a hydrogen atom or an aliphatic, aromatic or heterocyclic group, or $R_1$ and $R_2$ together with the nitrogen to which they are attached represent the atoms necessary to form a 5- or 6-membered ring or multiple ring system, or $R_1$ and $R_2$ are independently a —C(=O)(LINK)$_m$—INH group, or are substituted with a —NR$_3$C(=O)—(LINK)$_m$—INH, with $R_3$ being defined the same as $R_1$ or $R_2$, with the proviso that only one of $R_1$ and $R_2$ can be a hydrogen atom;.

This invention provides a film with enhanced backwards compatibility. The amido compound contained in the film enables the necessary contrast control during photothermographic processing, but has no effect during aqueous alkaline processing where a large release of inhibitor would result in sensitivity losses.

DETAILED DESCRIPTION OF THE INVENTION

Figure 1:
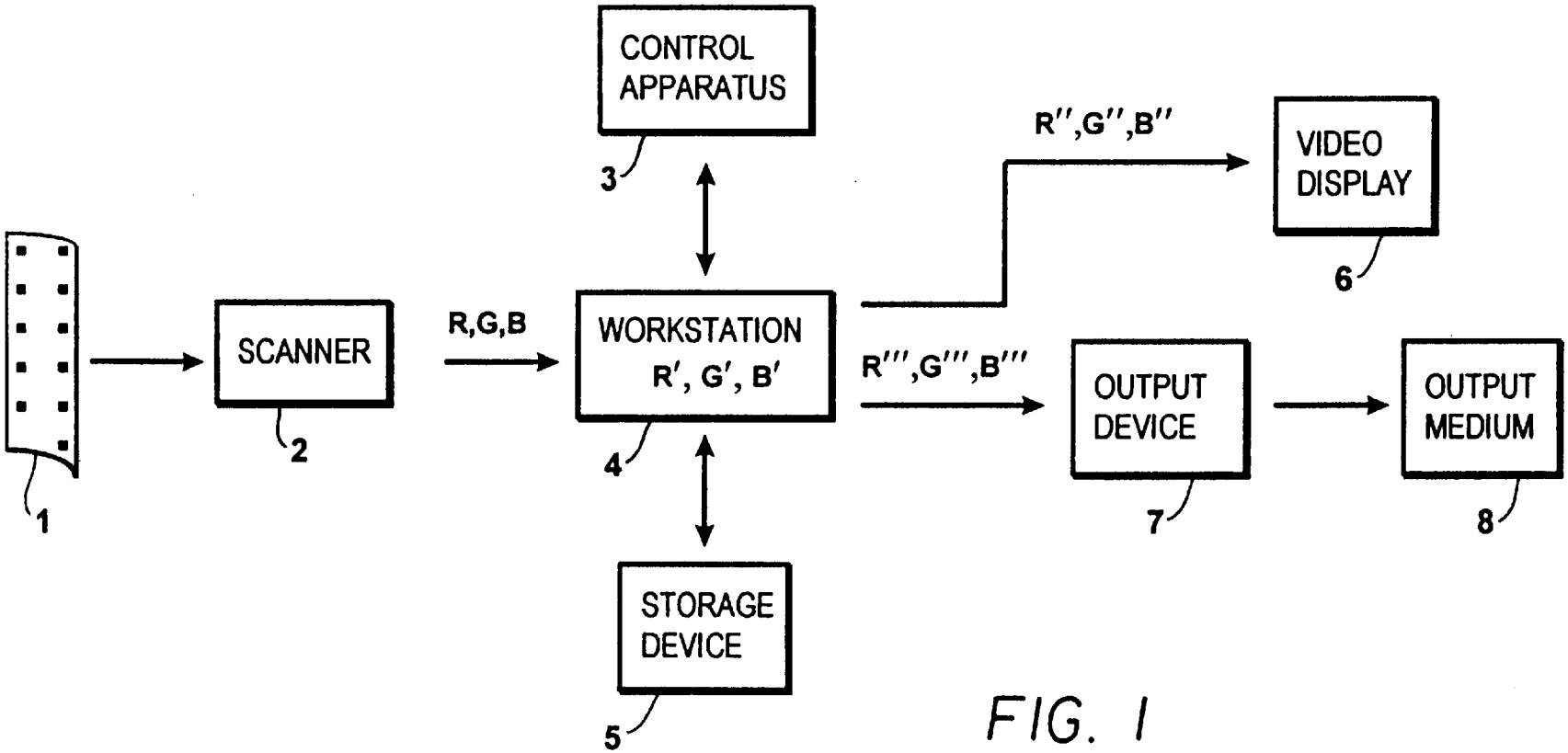
FIG. 1 shows in block diagram form an apparatus for processing and viewing image formation obtained by scanning the elements of the invention.

The present invention is directed to a silver halide-containing color photographic element that is capable of being alternatively developed in two diverse ways, either by a dry thermal process involving only incorporated developing agent or by a traditional wet-chemical process involving a sufficient amount of externally supplied developing agent for complete development.

By "traditional wet-chemical processing" or, synonomously, "wet-chemical processing" is herein meant a commercially standardized process in which the imagewise exposed color photographic element is contacted with, and preferably completely immersed in, an aqueous solution containing a developing agent, at a temperature of under 60° C., preferably 30° C. to 60° C. and more preferably 30° C. to 45° C., in order to form a color image from a latent image. The developing agent is an unblocked developing agent, preferably phenylenediamine or its equivalent, which (after oxidation) forms dyes by reacting with the image-dye couplers contained in the photographic element. Preferably the aqueous developer is agitated during development. The film element may then be desilvered, for example, bleached and fixed, to remove unwanted silver and silver halide, thereby forming a color negative film capable of use to make a positive image print. One example of such a process is the KODAK FLEXICOLOR (C-41) process as described in *British Journal of Photography Annual,* 1988, pp 191–198. Such processes are also described in *Research Disclosure* 40145, September 1997, Section XXIII. The incorporated reducing/developing agent and other components necessary for the alternative thermal development do not interfere with the wet-chemical processing.

By "dry thermal process" or "thermal process" is herein meant a process involving the use of heat to raise the temperature of the photothermographic element or film to a temperature of at least about 80° C., preferably at least about 100° C., more preferably at about 120° C. to 180° C., without liquid saturation of the film, preferably in an essentially dry process without the addition of any aqueous solutions. When dry developed, the imaged film may be electronically scanned without removing the silver and/or silver-halide. Thus, contrary to photothermographic processing involving low-volume liquid processing, the amount of water required is less than 0.1 times the amount required for maximally swelling total coated layers of the film excluding a back layer. Preferably no water is required or applied.

As indicated above, the color photographic element which can be subjected to either dry thermal or conventional wet-chemical processing comprises a support bearing at least two (preferably three) light-sensitive silver-halide emulsion units each having in reactive association at least one image dye coupler, a photosensitive silver halide and an oxidation-reduction image forming combination comprising (a) at least one organic silver salt as an oxidizing agent, also referred to as a silver donor and (b) an organic reducing agent or developing agent. The photographic element preferably further comprises a second silver salt or complex of an organic compound that is not, or at least not primarily, an oxidizing agent, but which prevents fogging of the film during thermal development, and which may be referred to as a thermal fog inhibitor.

The invention is also directed to a packaged article of manufacture comprising a photographic film element as described above which has at least three light-sensitive units which have their individual sensitivities in different wavelength regions, each of the units comprising at least one light-sensitive silver halide emulsion layer, an image dye coupler, and a blocked phenylenediamine developing agent. The packaged article of manufacture includes indicia for dual processing of the film. Indicia on the film package sold to the consumer can instruct or inform the consumer that the photographic film may be either (a) thermally developed, preferably at an automated kiosk that develops and scans the photographic film, before optionally printing it on a recording element, or alternatively, (b) developed in a wet-chemical process, preferably involving consecutively immersing the photographic film in multiple tanks, including at least one tank for developing the photographic film and at least one tank for desilvering the film. By kiosk is meant an automated free-standing machine, self-contained and (in exchange for certain payments) capable of developing a roll of imagewise exposed film on a roll-by-roll basis, without the intervention of technicians or other third-party persons such as is necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence, commercially transportable to diverse locations. Such kiosks may optionally comprise a heater for color development, a scanner for digitally recording the color image, and a device for transferring the color image to a display element.

A photographic element according to the present invention, comprises a support bearing a layer unit sensitive to a region of the electromagnetic spectrum which layer unit comprises a binder and, in reactive association, at least one image dye coupler, photosensitive silver halide, and an oxidation-reduction image forming combination comprising (a) at least one metallic salt or complex of an organic compound as an oxidizing agent, and (b) an organic reducing agent or developing agent. When thermal development is carried out, the thermally processed product (the developed film), according to the specified process parameters for the film, preferably exhibits a differential density in each record after scanning, a useful exposure latitude of at least 2.7 log E, and a $D_{min}$ less than 4.0. This would apply to three color records in a multilayer pack. More preferably, each record exhibits a gamma between 0.3 and 0.75, a $D_{min}$ less than 3.0, and an exposure latitude greater than 3.0 log E Another aspect of the invention is directed to a method of processing a commercial quantity of color photographic film sold to camera users over a given period of time, which film has been imagewise exposed in a camera, said film having at least three light-sensitive units which have their individual sensitivities in different wavelength regions, each of the units comprising at least one light sensitive silver halide emulsion, binder, and an image dye coupler. The commercial quantity involved will typically involve over one thousand rolls over a period of within 3 months to 1 year, more typically over one-hundred-thousand rolls of film. The geographical area, a contiguous area, preferably containing a plurality of kiosks for thermal film development, will involve greater than 10,000 persons, typically greater than 100,000 persons, preferably greater than 1,000,000 persons, and may involve politically determined geographical areas such as countries or divisions thereof, for example, counties, cities, states in the US, or comparable geographical entities in other countries. A geographical area is meant to include the place from where the film is actually submitted for development or the residence of the consumers submitting the film, rather than the place of film development, especially for film developed by a traditional wet-chemical process. Preferably, the commercial quantity of film developed according to the invention will eventually be over one million rolls developed in a given quarter (three-month period) of the year. By the term "substantial portion" is meant at least 5% of rolls of film, according to the present invention, developed in the given time period, preferably at least 10%. Preferably at least 25 to 99%, more preferably at least 50 to 90% of the film rolls in a given area and time period will be developed by the thermal process.

Accordingly, a substantial portion of said quantity of film will be developed by each of two routes.(Routes A and B, respectively). Preferably, when distributed to the consumer, the photographic element according to the present invention will be contained within a package including indicia indicating that the film may be processed and developed by either of two kinds of routes either A or B.

A first route (A), by which a substantial portion of said quantity of film will be processed, will involve a color development step without any externally applied developing agent, by thermal treatment of the film, by heating the film at a temperature greater than 80° C., preferably greater than 100° C., more preferably greater than 120° C., without liquid saturation of the film, preferably in an essentially dry process without the addition of any aqueous solutions, such that an incorporated reducing agent/developing agent in reactive association with each of said three light-sensitive units reacts with the image dye couplers to form a dye and thereby a color negative image. Preferably the reducing agent/developing agent is a blocked developer which becomes unblocked to form a developing agent, whereby the unblocked developing agent is imagewise oxidized on development and this oxidized form reacts with the image dye couplers to form a dye and thereby a color negative image. The color image may be scanned, optionally without desilvering, to provide a digital electronic record of the color image capable of generating a positive color image in a display element. The printed color image may, for example, be generated by thermal-diffusion or ink-jet printing.

A second route (B), corresponds to a wet-chemical process such as the Kodak C-41 Process and will involve a color development step comprising contacting the imagewise exposed color photographic film with a developing agent generally comprising a non-blocked p-phenylenediamine developing agent, preferably under agitation, at a temperature of less than 60° C., preferably 30 to 50° C. under aqueous alkaline conditions, in order to form a color negative image in the film by reaction of the non-blocked p-phenylenediamine developing agent with the image dye couplers, the dyes formed from the couplers in the three light-sensitive units being different in hue. This is optionally followed by desilvering said film in one or more desilvering solutions to remove unwanted silver and silver halide, thereby forming a color negative image; and thereafter optionally by scanning said film to give a digital electronic record, forming a positive-image color print from the desilvered film.

Preferably, the development processing Route B is carried out (i) for from 60 to 220, preferably 150 seconds to 200 seconds, (ii) at the temperature of a color developing solution of from 35 to 40° C., and (iii) using a color developing solution containing from 10 to 20 mmol/liter of a phenylenediamine developing agent. Preferably, the development processing Route A is carried out (i) less than 60 seconds, (ii) at the temperature from 120 to 180° C., and (iii) without the application of any aqueous solution.

In one embodiment of a method according to the present invention, the consumer who submits the film for development makes the choice of either color development route described above. The blocked developing agent, after being unblocked, may be the same compound as the non-blocked developing agent.

These two types of processing, Routes A and B, will now be described in more detail, beginning with Route A, the dry photothermographic process systems. After imagewise exposure of the photographic element (in fact, a photothermographic element by this route), the resulting latent image can be developed by heating the film at a temperature greater than 80° C., preferably greater than 100° C., more preferably greater than 120° C., without liquid saturation of the film, preferably in an essentially dry process without the addition of any aqueous solutions. This heating merely involves heating the photothermographic element to a temperature within the range above 80° C., preferably about 100° C. to 180° C., until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means is, for example, a simple hot plate, iron, roller, heated drum, microwave heating means, heated air, vapor or the like. Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the imageforming combination are in a location with respect to each other that enables the desired processing and forms a useful image. This may include the location of components in different layers.

The Route B process (wet-chemical process) will now be described in more detail. Photographic elements comprising the composition of the invention can be processed in any of a number of well-known photographic processes utilizing any of a number of well-known processing compositions, described, for example, in *Research Disclosure I,* in the *British Journal of Photography Annual,* 1988, pp 191–198, in *Research Disclosure* 40145, September 1997, Section XXIII. or in T. H. James, editor, *The Theory of the Photographic Process,* 4th Edition, Macmillan, New York, 1977. The development process may take place for a specified length of time and temperature, with minor variations, which process parameters are suitable to render an acceptable image.

In the case of processing a negative working element, the element is treated with a color developing agent (that is, one which will form the colored image dyes with the color couplers), and then with a oxidizer and a solvent to remove silver and silver halide. The developing agents are of the phenylenediamine type, as described below. Preferred color developing agents are p-phenylenediamines, especially any one of the following:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The color developer composition can be easily prepared by mixing a suitable color developer in a suitable solution. Water can be added to the resulting composition to provide the desired composition. And the pH can be adjusted to the desired value with a suitable base such as sodium hydroxide. The color developer solution for wet-chemical development can include one or more of a variety of other addenda which are commonly used in such compositions, such as antioxidants, alkali metal halides such as potassium chloride, metal sequestering agents such as aminocarboxylic acids, buffers to maintain the pH from about 9 to about 13, such as carbonates, phosphates, and borates, preservatives, development accelerators, optical brightening agents, wetting agents, surfactants, and couplers as would be understood to the skilled artisan. The amounts of such additives are well known in the art.

Dye images can be formed or amplified by processes which employ in combination with a dye-image-generating reducing agent an inert transition metal-ion complex oxidizing agent, as illustrated by Bissonette U.S. Pat. Nos. 3,748,138; 3,826,652; 3,862,842; and 3,989,526 and Travis U.S. Pat. No. 3,765,891; and/or a peroxide oxidizing agent as illustrated by Matejec U.S. Pat. No. 3,674,490; *Research Disclosure,* Vol. 116, December 1973, Item 11660; and Bissonette *Research Disclosure,* Vol. 148, August 1976, Items 14836, 14846, and 14847. The photographic elements can be particularly adapted to form dye images by such processes as illustrated by Dunn et al U.S. Pat. No. 3,822,129; Bissonette U.S. Pat. Nos. 3,834,907; and 3,902,905; Bissonette et al U.S. Pat. No. 3,847,619; Mowrey U.S. Pat. No. 3,904,413; Hirai et al U.S. Pat. No. 4,880,725; Iwano U.S. Pat. No. 4,954,425; Marsden et al U.S. Pat. No. 4,983,504; Evans et al U.S. Pat. No. 5,246,822; Twist U.S. Pat. No. 5,324,624; Fyson EPO 0 487 616; Tannahill et al WO 90/13059; Marsden et al WO 90/13061; Grimsey et al WO 91/16666, Fyson WO 91/17479, Marsden et al WO 92/01972. Tannahill WO 92/05471; Henson WO 92/07299; Twist WO 93/01524 and WO 93/11460; and Wingender et al German OLS 4,211,460.

Development is followed by desilvering, such as bleach-fixing, in a single or multiple steps, typically involving tanks, to remove silver or silver halide, washing and drying. The desilvering in a wet-chemical process may include the use of bleaches or bleach fixes. Bleaching agents of this invention include compounds of polyvalent metal such as iron (III), cobalt (III), chromium (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are preferred bleaching agents, with ferric complexes of aminopolycarboxylic acids being preferred for bleach-fixing solutions. Examples of useful ferric complexes include complexes of:

nitrilotriacetic acid,
ethylenediaminetetraacetic acid,
3-propylenediamine tetraacetic acid,
diethylenetriamine pentaacetic acid,
ethylenediamine succinic acid,
ortho-diamine cyclohexane tetraacetic acid
ethylene glycol bis(aminoethyl ether)tetraacetic acid,
diaminopropanol tetraacetic acid,
N-(2-hydroxyethyl)ethylenediamine triacetic acid,
ethyliminodipropionic acid,
methyliminodiacetic acid,
ethyliminodiacetic acid,
cyclohexanediaminetetraacetic acid
glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes are disclosed in DE 4,031,757 and U.S. Pat. Nos. 4,294,914; 5,250,401; 5,250,402; 5,250,401; 5,250,402; 5,670,305; and EP 567,126.

Typical persulfate bleaches are described in *Research Disclosure,* December 1989, Item 308119, published by Kenneth Mason Publications, Ltd., Dudley Annex, 12a North Street, Emsworth, Hampshire PO10 & DQ, England, the disclosures of which are incorporated herein by reference. This publication will be identified hereafter as *Research Disclosure* BL. Useful persulfate bleaches are also described in *Research Disclosure,* May 1977, Item 15704; *Research Disclosure,* August 1981, Item 20831; and DE 3,919,551. Sodium, potassium and ammonium persulfates are preferred, and for reasons of economy and stability, sodium persulfate is most commonly used.

A bleaching composition may be used at a pH of 2.0 to 9.0. The preferred pH of the bleach composition is between 3 and 7. If the bleach composition is a bleach, the preferred pH is 3 to 6. If the bleach composition is a bleach-fix, the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, a bleaching solution may contain anti-calcium agents, such as 1-hydroxyethyl-1,1-diphosphonic acid; chlorine scavengers such as those described in G. M. Einhaus and D. S. Miller, *Research Disclosure,* 1978, vol. 175, p. 42, No. 17556; and corrosion inhibitors, such as nitrate ion, as needed.

Bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. Bleaching compositions may be formulated as the working bleach solutions, solution concentrates, or dry powders. The bleach compositions of this invention can adequately bleach a wide variety of photographic elements in 30 to 240 seconds.

Bleaches may be used with any compatible fixing solution. Examples of fixing agents which may be used in either the fix or the bleach fix are water-soluble solvents for silver halide such as a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used. The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-current flow tank configurations. A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Conventional techniques for processing are illustrated by *Research Disclosure* BL, Paragraph XIX.

Examples of how processing of a film according to the present invention in a wet-chemical process may occur are as follows:

(1) development→bleaching→fixing
(2) development→bleach fixing
(3) development→bleach fixing→fixing
(4) development→bleaching→bleach fixing
(5) development→bleaching→bleach fixing→fixing
(6) development→bleaching→washing→fixing
(7) development→washing or rinsing→bleaching→fixing
(8) development→washing or rinsing→bleach fixing
(9) development→fixing→bleach fixing
(10) development→stopping→bleaching→fixing
(11) development→stopping→bleach fixing The amido compounds of this invention are blocked inhibitors and are represented by the following formula:

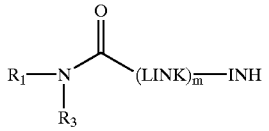

INH is a development inhibitor moiety. Examples of INH include, but are not limited to, substituted or unsubstituted mercaptotetrazoles, mercaptotriazoles, dimercaptothiadiazoles, mercaptooxadiazoles, mercaptoimidazoles, mercaptobenzoimidazoles, mercaptobenzoxazoles, mercaptobenzothiazoles, tetrazoles, 1,2,3-triazoles, 1,2,4-triazoles, benzotriazoles or imidazoles. Preferably INH is a substituted or unsubstituted heterocyclic ring or multiple ring system containing 1 to 4 nitrogen atoms, and most preferably INH is a substituted or unsubstituted benzotriazole.

$R_1$ and $R_2$ can independently be a hydrogen atom or any substituents which are suitable for use in a silver halide photographic element and which do not interfere with the contrast enhancing activity of the amido compound. However, at least one of $R_1$ and $R_2$ must be a substituent group. Preferably one of $R_1$ and $R_2$ is a hydrogen atom. $R_1$ and $R_2$ may independently represent a substituted or unsubstituted aliphatic, aromatic or heterocyclic group, or $R_1$ and $R_2$ together with the nitrogen to which they are attached represent the atoms necessary to form a substituted or unsubstituted 5- or 6-membered ring or multiple ring system. $R_1$ and $R_2$ may independently be a —C(=O)(LINK)$_m$—INH group. Also, $R_1$ and $R_2$ may independently be substituted with a —$NR_3$C(=O)—(LINK)$_m$—INH group, with $R_1$ or $R_2$ forming a bridge between two or more inhibitor releasing groups. $R_3$ is defined the same as $R_1$ or $R_2$. This allows the amido compound to be able to release more than one inhibitor moiety.

When $R_1$ and $R_2$ are aliphatic groups, preferably, they are alkyl groups having from 1 to 32 carbon atoms, or alkenyl or alkynyl groups having from 2 to 32 carbon atoms. More preferably, they are alkyl groups having 6 to 30 carbon atoms, or alkenyl or alkynyl groups having 6 to 30 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms. More preferably, the aromatic groups have 6 to 10 carbon atoms and include, among others, phenyl and naphthyl groups. These groups may or may not have substituent groups. The heterocyclic groups are substituted or unsubstituted 3 to 15-membered rings with at least one atom selected from nitrogen, oxygen, sulfur, selenium and tellurium. More preferably, the heterocyclic groups are 5- to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

$R_1$ and $R_2$ may together form a ring or multiple ring system. These ring systems may be unsubstituted or substituted. The ring and multiple ring systems formed by $R_1$ and $R_2$ may be alicyclic or they may be the aromatic and heterocyclic groups described above.

The choice of $R_1$ and $R_2$ is determined by their effects on the water solubility and melting point of the amido compound. The compound can be incorporated into the film in a number of ways. If it is to be added as part of an aqueous solution, sufficiently high water solubility is needed. If to be added as a solid particle dispersion, then a higher melting, more crystalline amido compound with low water solubility is needed to prevent recrystallization (particle growth) during dispersion making and storage. Further, if the amido compound is to be incorporated in fine droplets of a high boiling solvent, then solubility in the solvent and stability (to avoid crystallization or particle growth) in the droplet are important. These design features are well known to those skilled in the art. Whatever the incorporation method, it should not adversely affect the release of inhibitor at the processing temperature.

Non-limiting examples of substituent groups for INH, $R_1$ and $R_2$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 6 carbon atoms (for example, methyl) and halogen groups (for example, chloro). INH may also be substituted with additional —$NR_3$C(=O)—(LINK)$_m$—INH groups, where $R_3$ is defined the same as $R_1$ or $R_2$.

LINK may be any linking or timing group which does not interfere with the function of the amido compound, although it may modify the rate of release of the inhibitor from the amido compound, and which is suitable for use in a photothermographic system. m is 0, 1, or 2. Many such linking groups are known to those skilled in the art and some are known as timing groups. They include such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intra-molecular nucleophilic substitution reaction (U.S. Pat. No. 4,248,962).

Illustrative timing groups are illustrated by formulae T-1 through T-4:

T-1

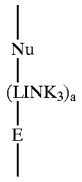

wherein:

Nu is a nucleophilic group;

E is an electrophilic group comprising one or more carbon or hetero-aromatic rings, containing an electron deficient carbon atom;

LINK 3 is a linking group that provides 1 to 5 atoms in the direct path between the nucleophilic site of Nu and the electron deficient carbon atom in E; and a is 0 or 1.

Such timing groups include, for example:

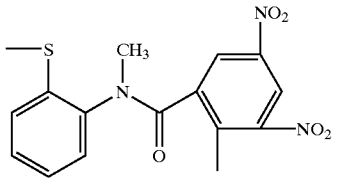

and

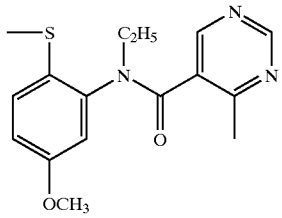

These timing groups are described more fully in U.S. Pat. No. 5,262,291, incorporated herein by reference.

T-2

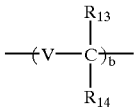

wherein

V represents an oxygen atom, a sulfur atom, or an

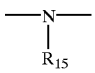

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

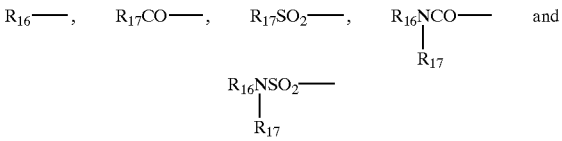

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

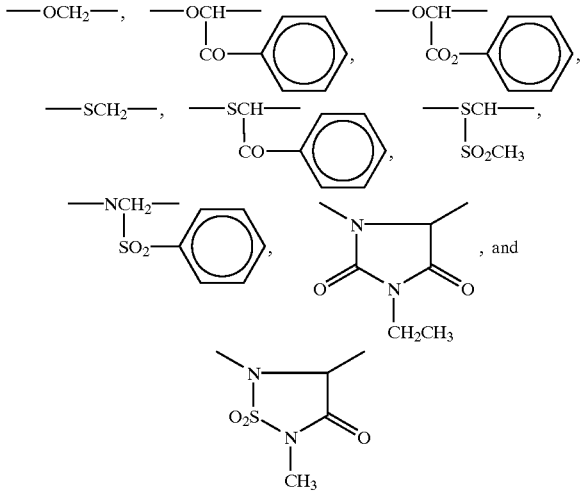

T-3 wherein Nu1 represents a nucleophilic group, and an oxygen or sulfur atom can be given as an example of nucleophilic species; E1 represents an electrophilic group being a group which is subjected to nucleophilic attack by Nu1; and LINK 4 represents a linking group which enables Nu1 and E1 to have a steric arrangement such that an intramolecular nucleophilic substitution reaction can occur. Specific examples of the group represented by formula (T-3) are illustrated below.

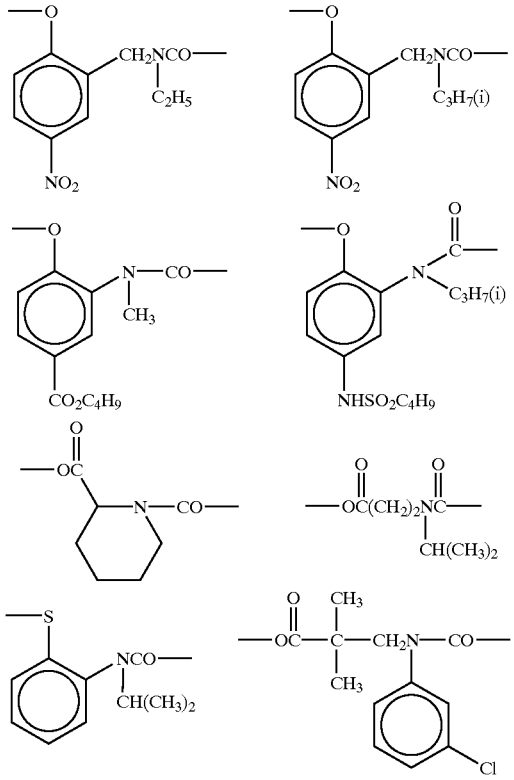

T-4

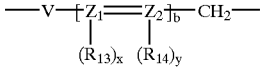

wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

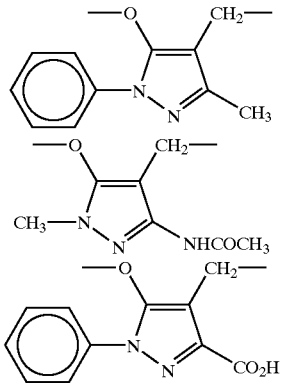

-continued

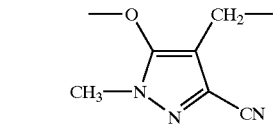

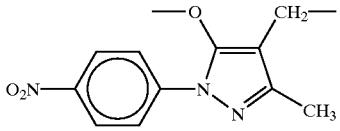

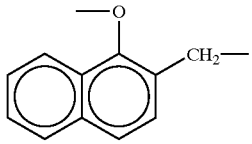

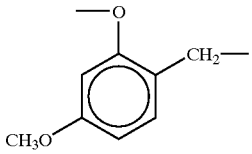

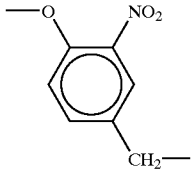

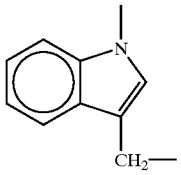

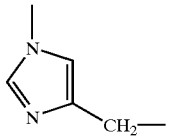

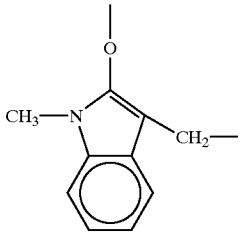

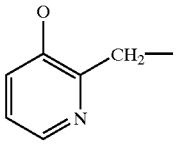

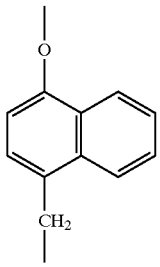

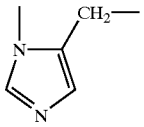

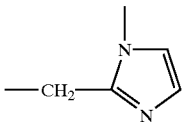

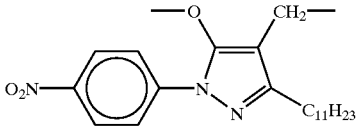

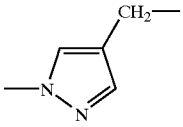

In one embodiment of the invention, LINK is of structure II:

II

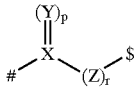

wherein

X represents carbon or sulfur;

Y represents oxygen, sulfur or N—$R_5$, where $R_5$ is substituted or unsubstituted alkyl or substituted or unsubstituted aryl;

p is 1 or 2;

Z represents carbon, oxygen or sulfur;

r is 0 or 1; with the proviso that when X is carbon, both p and r are 1, when X is sulfur, Y is oxygen, p is 2 and r is 0;

# denotes the bond to INH:

$ denotes the bond to C(═O)$NR_1R_2$—

Illustrative linking groups include, for example,

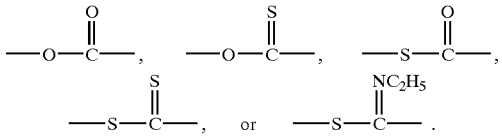

Non-limiting examples of the amido compounds include the following.

D2

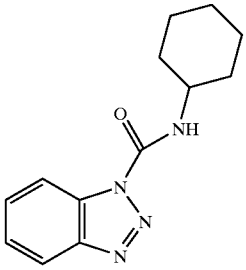

D4

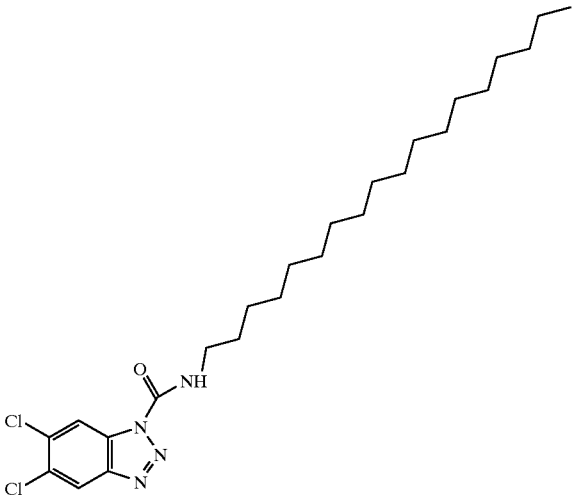

-continued

D5

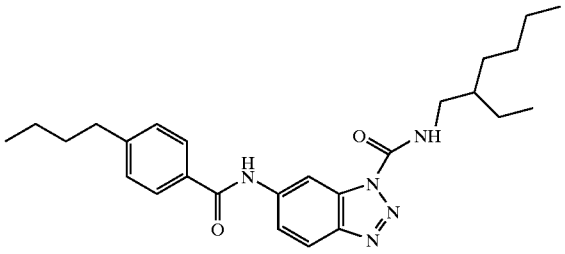

D12

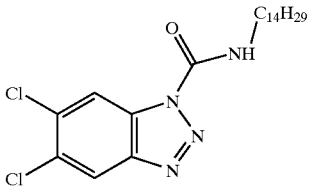

D13

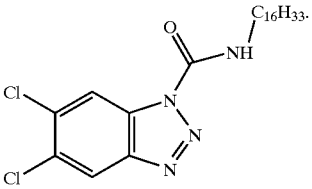

Only certain amido compounds are useful in the current invention. The amido compounds must reduce contrast in the photothermograhic system but must not significantly affect contrast when the element is processed in a traditional wet processing system. Preferably the amido compound effectively reduces contrast when the film is developed by heating above 80° C. but does not substantially reduce contrast when the film is processed by contacting the image-wise exposed color photographic film with a non-blocked developing agent under aqueous conditions, at a temperature of between 30 to 60° C. Two methods by which contrast reduction in aqueous processing solutions can be avoided are described below.

(1) Useful amido compounds depend on the strength of the inhibitor. Some useful compounds release an inhibitor which is effective in thermal development systems, yet is ineffective in aqueous systems because the inhibitor is so weak a silver development inhibitor in such systems. For example, D-2, which releases a benzotriazole inhibitor, known to be an ineffective inhibitor in aqueous systems, is a suitable amido compound; unlike D-3, a comparative example, which releases the stronger inhibitor 5,6-dichlorobenzotriazole. The inhibition effects in aqueous developer solutions are determined by the ability of the inhibitor to diffuse to the developing silver surface and by the stability of the silver complex formed, involving the pKsp measurements described in J. Pouradier, A. Pailliotet and C. R. Berry in "The Theory of the Photographic Process" (Fourth Edition, Macmillan, 1997) P8 et seq. This reference lists the pKsp values for a variety of silver ligands. This parameter is a measure of the solubility product of the silver salts of the respective ligands. Preferably when the pKsp is below about 13.6, the ligand can be described as a weak inhibitor in a silver iodobromide system that is aqueous processed using protocols like, for example, Kodak C-41 and thus is useful in the invention. Although other factors are also involved in inhibitory strength,(e.g., the ability to diffuse from point of release to the silver surface) this factor is a useful guide. From the table in James, benzotriazole has a pKsp equal to 13.4, and so its release would not be expected to affect development in Kodak C-41 processing. PMT has a pKsp equal to 16.2 and so a big effect would be expected. The strength of the inhibitor in a particular aqueous system is also determined by the pH, temperature, process time and composition of the development solution as well as the types (morphology and halide content, etc.) of silver halide photographic emulsions.

(2) Other useful amido compounds are not soluble enough to react to release inhibitor in an aqueous system or their rate of release by hydrolysis or other nucleophilic attack is slow such that inhibition is minimized. In these cases the molecules are sufficiently ballasted so that their solubility in the aqueous phase is too low for enough hydrolysis to occur to effect release of the 5,6-dichlorobenzotriazole in the time scale necessary for inhibition in aqueous processing. The calculated logarithm of the octanol/water, partition coefficient, clogP, is a measure well known in the art to describe the hydrophilicity of compounds. For the blocked benzotriazole based inhibitors it was estimated using the following procedure, because an exact estimate was not available from the MEDCHEM software, release 3.54 (Pomona College, California).

1. the clogP for 1-H-benzotriazol-1yl, methyl urea was measured by experiment to be 1.77.
2. the clogP of the blocked inhibitors were calculated, based on this urea using MEDCHEM.

Note: the clogP estimate for D1 assumes alkyl and aryl ureas partition similarly.

The exact clogP values(lower limit) used as an indicator to determine whether a compound will release inhibitor in an aqueous system, will vary if there are ionizable groups on the molecule and will also be affected by the structural features of the inhibitor. That is, useful clogp values will be dependent on the inhibitor strength in thermal or aqueous development and the rate of release of the inhibitor, which are both affected by inhibitor structure. Additionally the extent of ballasting that is needed will depend on the pH, temperature, process time and composition of the aqueous developer solution and on the method by which the blocked inhibitor is incorporated into the film element. In one suitable embodiment the amido compounds have a clogp of greater than about 10.0.

Useful levels of the amido compounds may range from 0.1 to 1500 micromoles/$m^2$. A more preferred range is from 1 to 1000 micromoles/$m^2$ with the most preferred range being from 5 to 500 micromoles/$m^2$. The amido compounds may be added to the photographic element using any technique suitable for this purpose. They may be dissolved in most common organic solvents, for example, methanol or acetone. They can be added in the form of a liquid/liquid dispersion similar to the technique used with certain couplers or they can also be added as a solid particle dispersion. Solid Particle dispersion is a particularly useful method of incorporation for these materials. The addition of the amido compounds may be carried out at any stage of the preparation of the photographic element. Preferably the amido compounds are incorporated in a silver halide emulsion layer. The amido compounds may be used in combinations of different types, having either different inhibitor groups or different blocking groups. The amido compounds may also be used in combination with blocked photographic developers.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art.

Alkyl substituents may specifically include "lower alkyl" (that is, having 1–6 carbon atoms), for example, methyl, ethyl, and the like. Further, with regard to any alkyl group or alkylene group, it will be understood that these can be branched, un-branched or cyclic.

The silver halide photothermographic imaging element utilized in the invention is one where processing may be initiated solely by the application of heat to the imaging element as described earlier. Photothermographic elements of Type B described in *Research Disclosure* 17029, June 1978, are included by reference. Type B elements contain in reactive association a photosensitive silver halide, a reducing agent or developer, a salt or complex of an organic compound with silver ion, and a coating vehicle or binder. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992. Fixing and/or bleach/fixing may follow development, to remove silver halide and/or silver, washing and drying.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts, which are substitutable with a halogen atom or a hydroxyl group, can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123, 274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese Patent Application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese Patent Publications 30270/69 and 18146/70, for example, a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure,* Item 17029, cited above, as well as U.S. Pat. No. 3,700,458 and published Japanese Patent Application Nos. 32928/75, 13224/74, 17216/75 and 42729/76.

A photographic element utilized in the present invention, in order to enable thermal processing includes a reducing agent, preferably a blocked developing agent. The reducing agent for the organic-silver salt may be any material, preferably organic material that can reduce silver ion to metallic silver. Conventional photographic developers such as 3-pyrazolidinones, hydroquinones, p-aminophenols, p-phenylenediamines and catechol are useful, with hindered phenol and p-phenylenediamine reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbetboxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

Examples of blocked developers that can be used in photographic elements of the present invention include, but are not limited to, the blocked developing agents described in U.S. Pat. No. 3,342,599 to Reeves; *Research Disclosure* 129 (1975) pp. 27–30 published by Kenneth Mason Publications, Ltd., Dudley Annex, 12a North Street, Emsworth, Hampshire PO10 7DQ, ENGLAND; U.S. Pat. No. 4,157,915 to Hamaoka et al; U.S. Pat. No. 4,060,418 to Waxman and Mourning; and U.S. Pat. No. 5,019,492. Particularly useful are those blocked developers described in U.S. application Ser. No. 09/476,234 filed Dec. 30, 1999, IMAGING ELEMENT CONTAINING A BLOCKED PHOTOGRAPICALLY USEFUL COMPOUND; U.S. Pat. No. 6,306,551 of Owczarczyk et al; U.S. application Ser. No. 09/475,703 filed Dec. 30, 1999, IMAGING ELEMENT CONTAINING A BLOCKED PHOTOGRAPHICALLY USEFUL COMPOUND; U.S. application Ser. No. 09/475,690 filed Dec. 30, 1999, IMAGING ELEMENT CONTAINING A BLOCKED PHOTOGRAPHICALLY USEFUL COMPOUND; and U.S. Pat. No. 6,312,879 of Slusarek et el. Further improvements in blocked developers are disclosed in U.S. application Ser. No. 09/710,341 filed Nov. 9, 2000, IMAGING ELEMENT CONTAINING A BLOCKED PHOTOGRAPHICALLY USEFUL COMPOUND; U.S. application Ser. No. 09/718,014 filed Nov. 20, 2000, IMAGING ELEMENT CONTAINING A BLOCKED PHOTOGRAPHICALLY USEFUL COMPOUND; U.S. Pat. No. 6,317,640 of Slusarek; and U.S. application Ser. No. 09/710,348 filed Nov. 9, 2000, COLOR PHOTOTHERMOGRAPHIC ELEMENTS COMPRISING BLOCKED DEVELOPING AGENTS. Yet other improvements in blocked developers and their use in photothermographic elements are found in commonly assigned copending applications U.S. application Ser. No. 09/718,027 filed Nov. 20, 2000, PHOTOTHERMOGRAPHIC ELEMENT CONTAINING A MIXTURE OF BLOCKED DEVELOPERS; and U.S. application Ser. No. 09/717,742 filed Nov. 20, 2000, COLOR PHOTOTHERMOGRAPHIC ELEMENT CONTAINING A MIXTURE OF BLOCKED DEVELOPERS FOR BALANCING IMAGING LAYERS.

The blocked developer may be represented by the following Structure A:

$$\text{DEV—(LINK 1)}_{1}\text{—(TIME)}_{m}\text{—(LINK 2)}_{n}\text{—B} \qquad \text{A}$$

wherein,

DEV is a silver-halide color developing agent;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_{n}\text{—(TIME)}_{m}\text{—(LINK 1)}_{1}\text{—DEV}$$

wherein B' also blocks a second developing agent DEV.

In a preferred embodiment of the invention, LINK 1 or LINK 2 are of structure II:

II

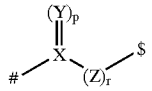

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1; with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

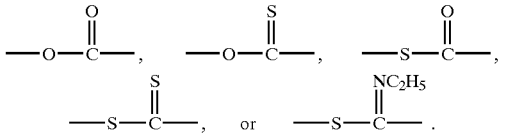

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

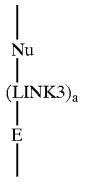

wherein:

Nu is a nucleophilic group;

E is an electrophilic group comprising one or more carbo- or heteroaromatic rings, containing an electron deficient carbon atom;

LINK 3 is a linking group that provides 1 to 5 atoms in the direct path between the nucleophilic site of Nu and the electron deficient carbon atom in E; and a is 0 or 1.

Such timing groups include, for example:

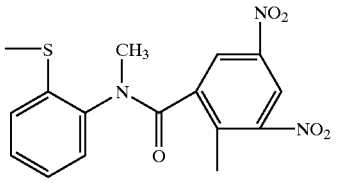

and

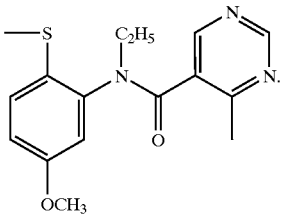

These timing groups are described more fully in U.S. Pat. No. 5,262,291, incorporated herein by reference.

T-2

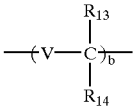

wherein

V represents an oxygen atom, a sulfur atom, or an

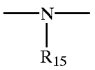 group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

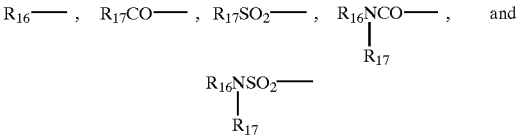

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

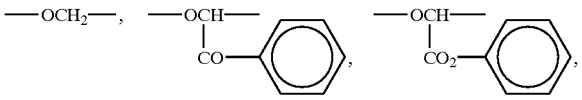

-continued

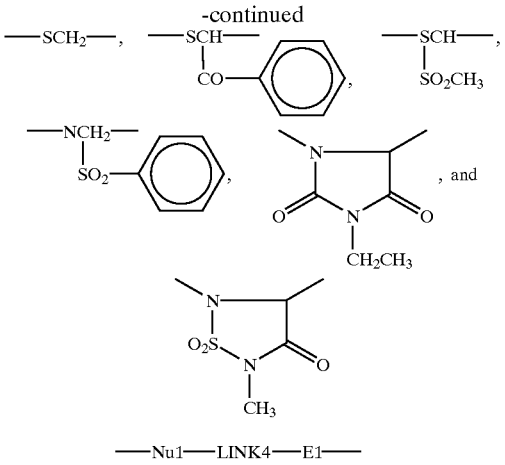

T-3 wherein Nu1 represents a nucleophilic group, and an oxygen or sulfur atom can be given as an example of nucleophilic species; E1 represents an electrophilic group being a group which is subjected to nucleophilic attack by Nu1; and LINK 4 represents a linking group which enables Nu1 and E1 to have a steric arrangement such that an intramolecular nucleophilic substitution reaction can occur. Specific examples of the group represented by formula (T-3) are illustrated below.

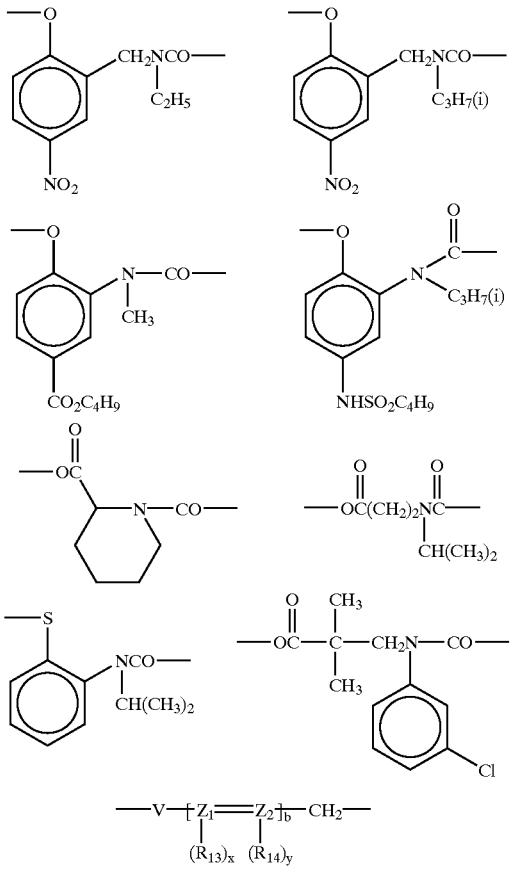

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

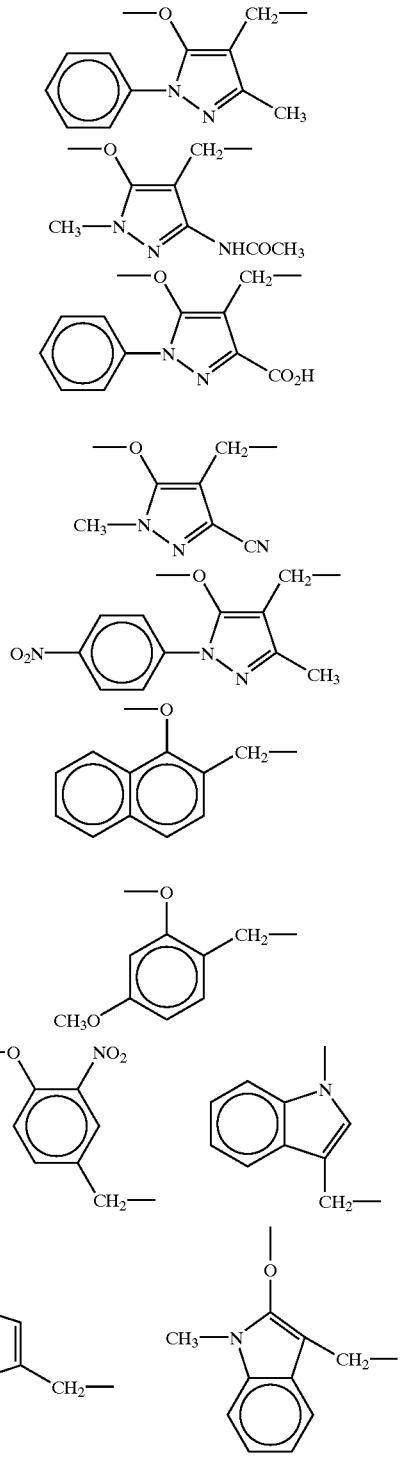

-continued

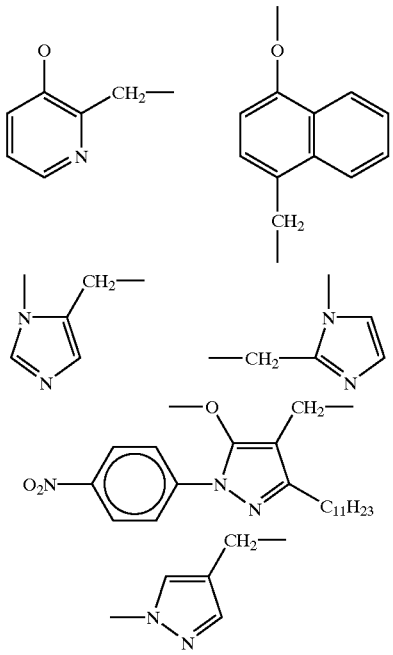

More specifically, as indicated above, the color photothermographic element of the present invention comprises a blocked developer having a half life of less than or equal to 20 minutes and a peak discrimination, at a temperature of at least 60° C., of at least 2.0, which blocked developer is represented by the following Structure I:

I

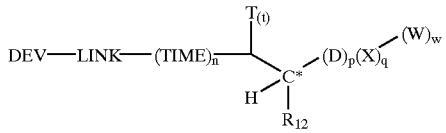

wherein:

DEV is a developing agent;

LINK is a linking group as described above for LINK 1 and LINK 2;

TIME is a timing group as described above;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN; a halogenated alkyl group, for example, —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc. A particularly preferred T group is an aryl group substituted with one to seven electron withdrawing groups.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any tetrahedral carbon atoms except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(OR_{15})N(R_{16})$—, and the like, in which the atoms in the backbone of the X group (in a direct line between the C* and W) are not attached to any hydrogen atoms.

W is W' or a group represented by the following Structure IA:

IA

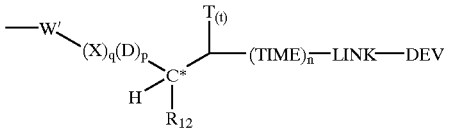

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IA, W' comprises a least one substituent, namely the moiety to the right of the W' group in Structure IA, which substituent is by definition activating, comprising either X or D);

W is an activating group when W has structure IA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, or —CN; or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members (which are not directly linked) of the following set: $R_{12}$, T, and either D or W, may be joined to form a ring, provided that creation of the ring will not interfere with the functioning of the blocking group.

In one embodiment of the invention, the blocked developer is selected from Structure I with the proviso that when t is 0, then D is not —CN or substituted or unsubstituted aryl and X is not —$SO_2$— when W is substituted or unsubstituted aryl or alkyl; and when t is not an activating group, then X is not —$SO_2$— when W is a substituted or unsubstituted aryl.

In the above Structure I, the T, $R_{12}$, X or D, W groups are selected such that the blocked developer exhibits a half life of less than or equal to 20 minutes (as determined in the Examples) and a peak discrimination, at a temperature of at least 60° C., of at least 2.0. The specified half-life can be obtained by the use of activating groups in certain positions in the blocking moiety of the blocked developer of Structure I. More specifically, it has been found that the specified half-life can be obtained by the use of activating groups in the D or X position. Further activation to achieve the specified half-life may be obtained by the use of activating groups in one or more of the T and/or W positions in Structure I. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, in addition to D or X, in at least one of the T or W groups.

By the term inorganic is herein meant a group not containing carbon excepting carbonates, cyanides, and cyanates. The term heterocyclic herein includes aromatic and non-aromatic rings containing at least one (preferably 1 to 3) heteroatoms in the ring. If the named groups for a symbol such as T in Structure I apparently overlap, the narrower named group is excluded from the broader named group solely to avoid any such apparent overlap. Thus, for example, heteroaromatic groups in the definition of T may be electron withdrawing in nature, but are not included under monovalent or divalent electron withdrawing groups as they are defined herein.

In has further been found that the necessary half-life can be obtained by the use of activating groups in the D or X position, with further activation as necessary to achieve the necessary half-life by the use of electron withdrawing or heteroaromatic groups in the T and/or W positions in Structure I.

By the term activating groups is meant electron withdrawing groups, heteroaromatic groups, or aryl groups substituted with one or more electron withdrawing groups. Preferably, in addition to D or X, at least one of T or W is an activating group.

When referring to electron withdrawing groups, this can be indicated or estimated by the Hammett substituent constants ($\sigma_p$, $\sigma_m$), as described by L. P. Hammett in Physical Organic Chemisty (McGraw-Hill Book Co., NY, 1940), or by the Taft polar substituent constants ($\sigma_I$) as defined by R. W. Taft in Steric Effects in Organic Chemistry (Wiley and Sons, NY, 1956), and in other standard organic textbooks. The $\sigma_p$ and $\sigma_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\sigma_p$ and $\sigma_m$ are widely available in the chemical literature, as for example in C. Haunch et al, J. Med. Chem., 17, 1207 (1973). For substituents attached to a tetrahedral carbon instead of aryl groups, the inductive substituent constant $\sigma_I$ is herein used to characterize the electronic property. Preferably, an electron withdrawing group on an aryl ring has $\sigma_p$ or $\sigma_m$ of greater than zero, more preferably greater than 0.05, most preferably greater than 0.1. The $\sigma_p$ is used to define electron withdrawing groups on aryl groups when the substituent is neither para nor meta. Similarly, an electron withdrawing group on a tetrahedral carbon preferably has a $\sigma_I$ of greater than zero, more preferably greater than 0.05, and most preferably greater than 0.1. In the event of a divalent group such as —$SO_2$—, the $\sigma_I$ used is for the methyl substituted analogue such as —$SO_2CH_3$ ($\sigma_I$=0.59). When more than one electron withdrawing group is present, then the summation of the substituent constants is used to estimate or characterize the total effect of the substituents.

Illustrative developing agents that are useful as developers are:

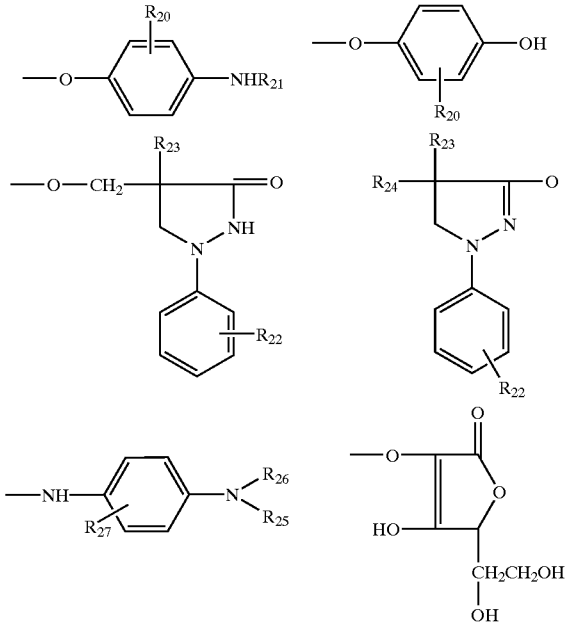

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

A preferred class of blocked developers is represented by the following Structure II:

III

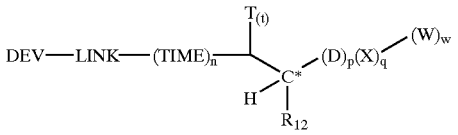

wherein:

DEV is a developing agent;

LINK is a linking group as defined above;

TIME is a timing group as defined above;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to, form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN, a halogenated alkyl group, for example, —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any hydrogenated carbons except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(R_{15})N(R_{16})$—, and the like, in which the atoms in the backbone of the X group (in a direct line between the C* and W) are not attached to any hydrogen atoms.

W is W' or a group represented by the following Structure IIIA:

IIIA

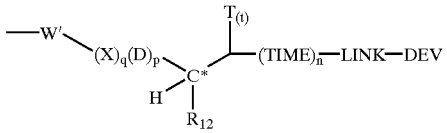

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IA), W' comprises a least one substituent, namely the moiety to the right of the W' group in Structure IA, which substituent is by definition activating, comprising either X or D);

W is an activating group when W has structure IA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, —CN, or a halogenated alkyl group, e.g., —$CF_3$, or an inorganic group capped by $R_{13}$ (or by $R_{13}$ and $R_{14}$), for example, —$SO_2R_{13}$, —$OSO_2R_{13}$, —$NR_{13}(SO_2R_{14})$, —$CO_2R_{13}$, —$COR_{13}$, —$NR_{13}(COR_{14})$, etc., $R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members (which are not directly linked) of the following set: $R_{12}$, T, and either D or W, that are not directly linked may be joined to form a ring, provided that creation of the ring will not interfere with the functioning of the blocking group.

Preferably, blocked developers are selected from Structure III such that the blocked developers have a half-life ($t_{1/2}$)≦20 min (as determined below). In has further been found that the specified half-life can be obtained by the use of activating groups in certain positions in the blocking moiety of the blocked developer, as explained more fully below with respect to the specified structures. By the term activating groups is herein meant electron withdrawing groups, heteroaromatic groups, or aryl groups substituted with one or more electron withdrawing groups. More preferably, the color photothermographic element of the present invention comprises a blocked developer having a half life of less than or equal to 20 minutes and a peak discrimination, at a temperature of at least 60° C., of at least 2.0.

As indicated above, the specified half-life can be obtained by the use of activating groups in certain positions in the blocking moiety of the blocked developer of Structure III. More specifically, it has been found that the specified half-life can be obtained by the use of activating groups in the D or X position, with further activation to achieve the specified half-life by the use of activating groups in the one or more of the T and/or W positions in Structure I. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, not only at the D or X position, but also at the T and/or W position in Structure III.

More preferably, the blocked developers used in the present invention is within Structure I above, but represented by the following narrower Structure III:

More preferably, the blocked developers used in the present invention is within Structure I above, but represented by the following narrower Structure III:

Structure III

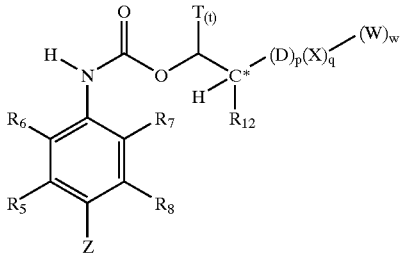

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following Structure IIIA:

Structure IIIA

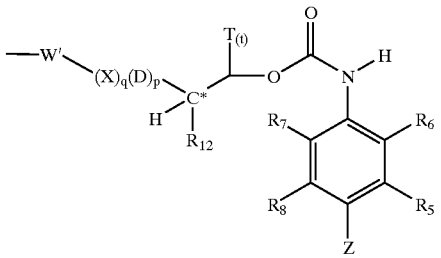

wherein T, t, C*, $R_{12}$, D, p, X, q, W' and w are as defined above, including, but not limited to, the preferred groups.

Again, the present invention includes photothermographic elements comprising blocked developers according to Structure III which blocked developers have a half-life $(t_{1/2}) \leqq 20$ min (as determined below).

When referring to heteroaromatic groups or substituents, the heteroaromatic group is preferably a 5- or 6-membered ring containing one or more hetero atoms, such as N, O, S or Se. Preferably, the heteroaromatic group comprises a substituted or unsubstituted benzimidazolyl, benzothiazolyl, benzoxazolyl, benzothienyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thienyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-, 4-, or 5-pyrazolyl, 3-indazolyl, 2- and 3-thienyl, 2-(1,3,4-triazolyl), 4- or 5-(1,2,3-triazolyl), 5-(1,2,3,4-tetrazolyl). The heterocyclic group may be further substituted. Preferred substituents are alkyl and alkoxy groups containing 1 to 6 carbon atoms.

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Cycloalkyl when appropriate includes bicycloalkyl. Further, with regard to any alkyl group or alkylene group, it will be understood that these can be branched, unbranched, or cyclic.

The following are representative examples of photographically useful blocked developers for use in the invention:

Dev-1
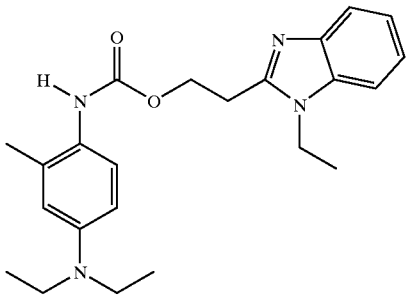
Dev-2
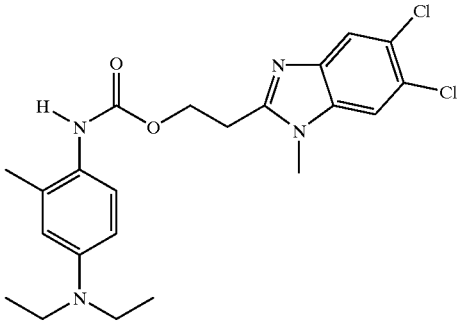
Dev-3
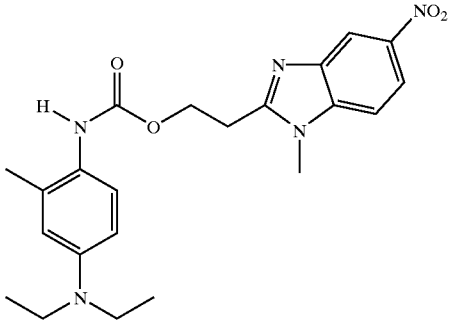
Dev-4
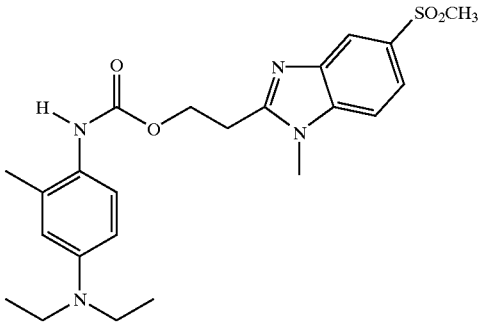
Dev-5
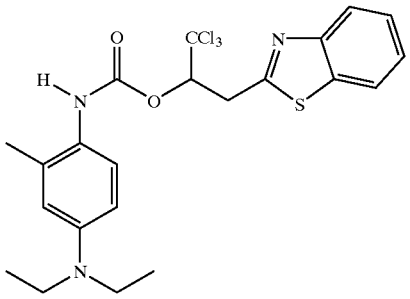
-continued
Dev-6
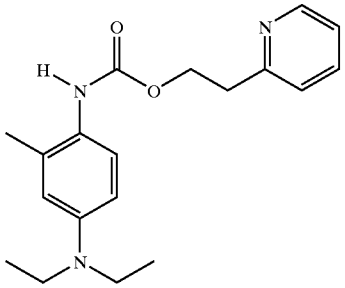
Dev-7
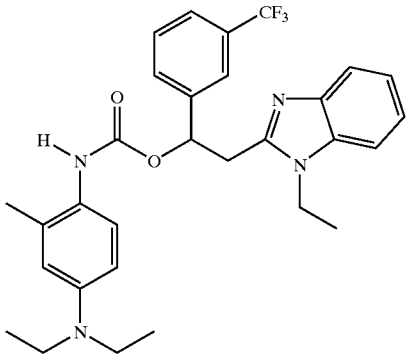
Dev-8
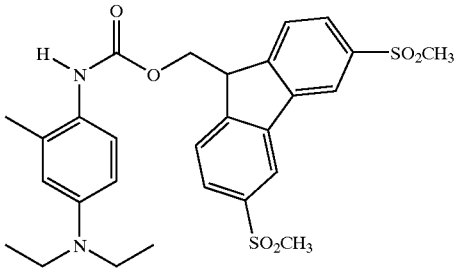
Dev-9
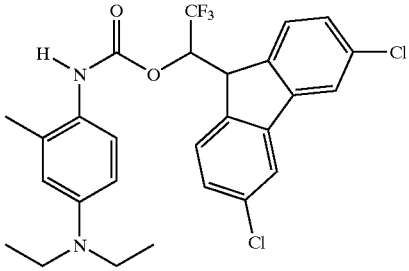
Dev-10
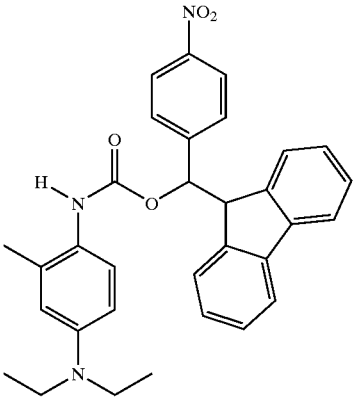

-continued
Dev-11
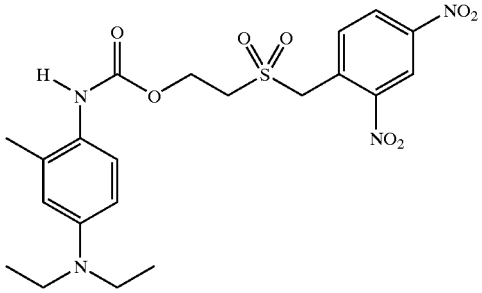
Dev-12
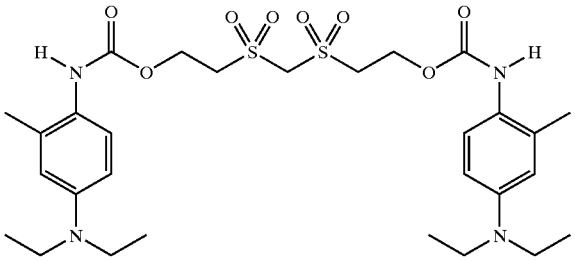
Dev-13
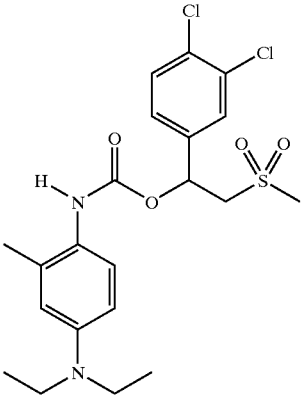
Dev-14
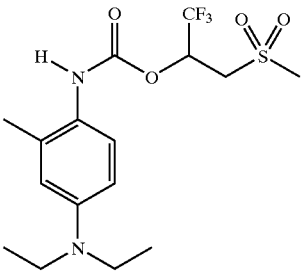
Dev-15
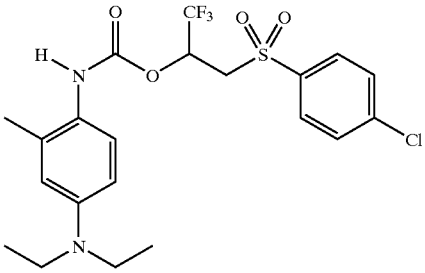
-continued
Dev-16
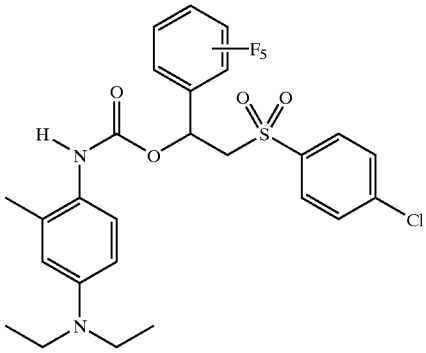
Dev-17
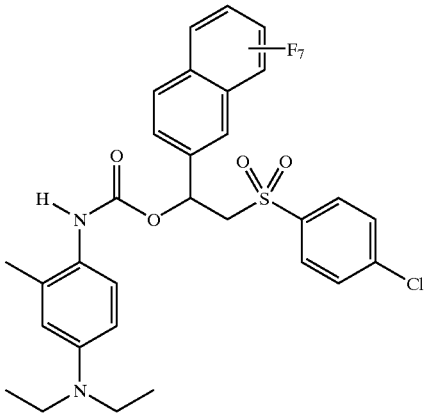
Dev-18
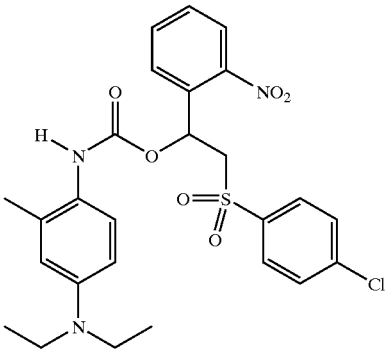
Dev-19
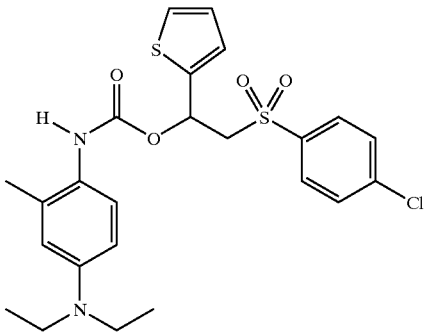

-continued
Dev-20
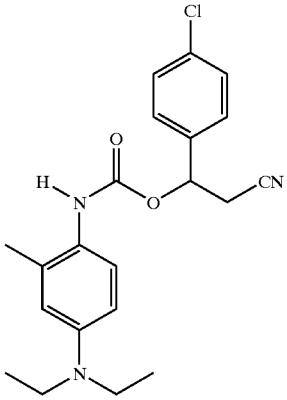
Dev-21
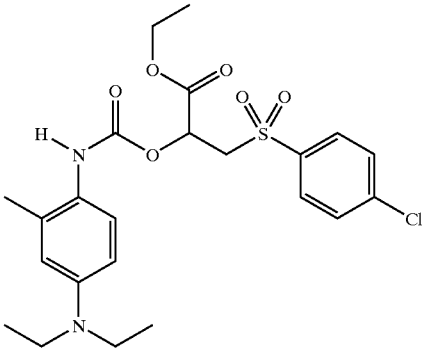
Dev-22
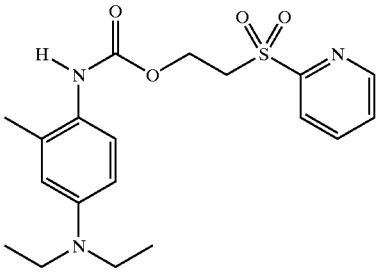
Dev-23
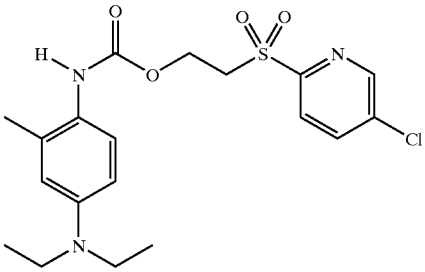
Dev-24
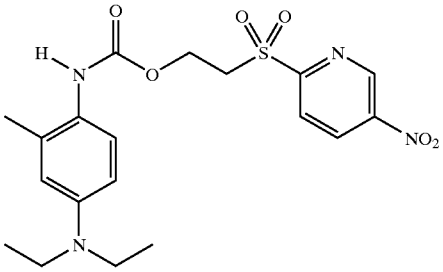
-continued
Dev-25
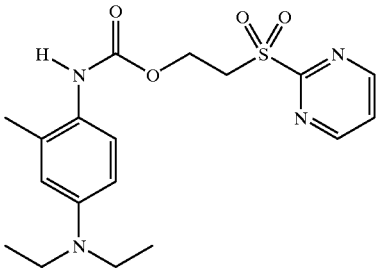
Dev-26
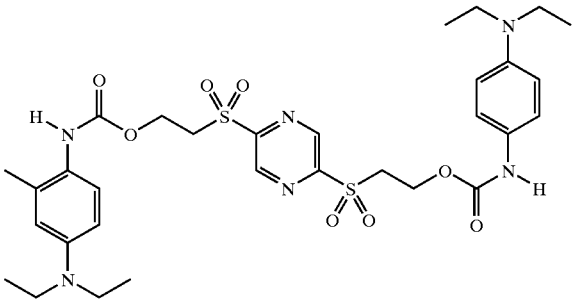
Dev-27
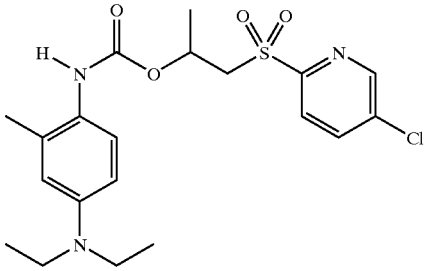
Dev-28
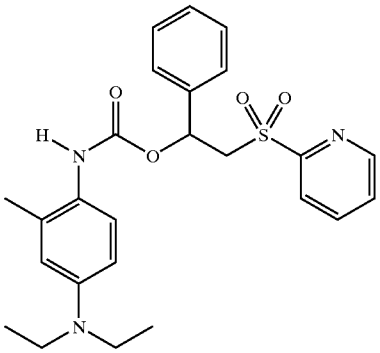
Dev-29
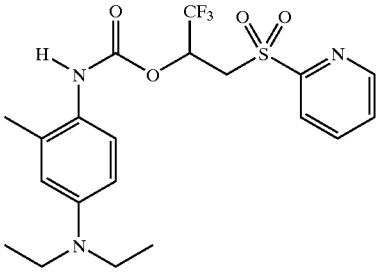

-continued
Dev-30
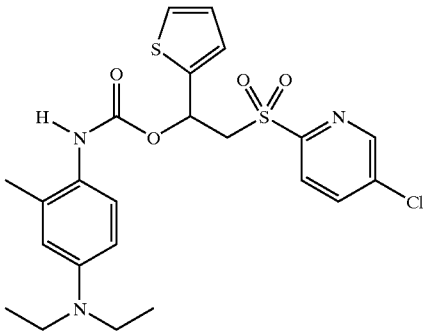
Dev-31
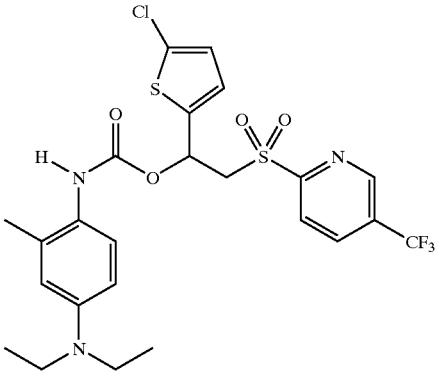
Dev-32
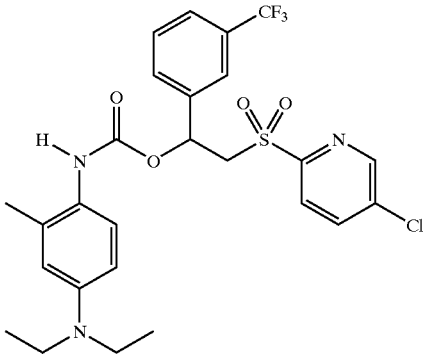
Dev-33
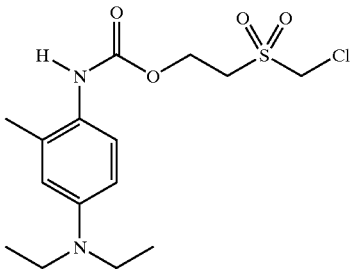
-continued
Dev-34
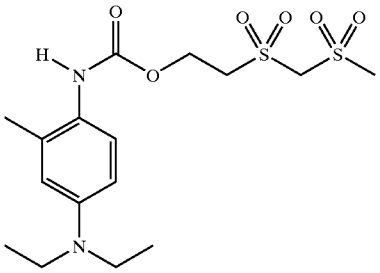
Dev-35
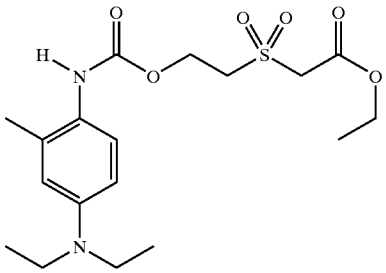
Dev-36
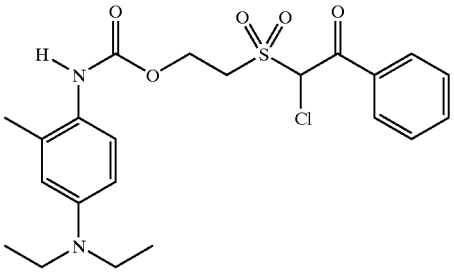
Dev-37
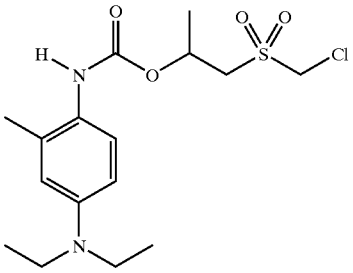
Dev-38
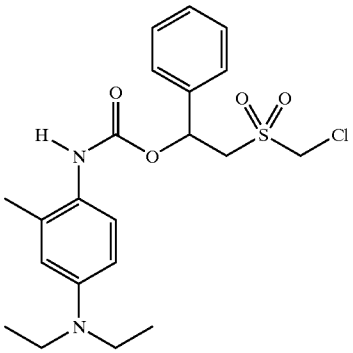

-continued

Dev-39

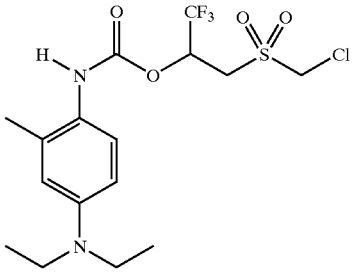

Dev-40

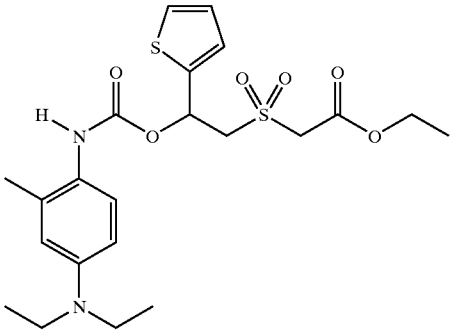

Dev-41

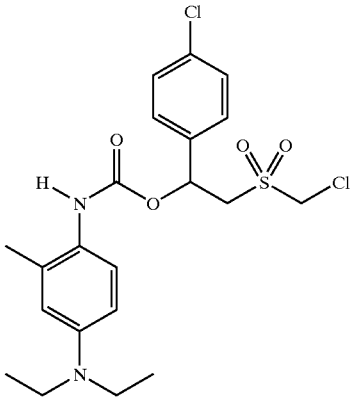

Dev-42

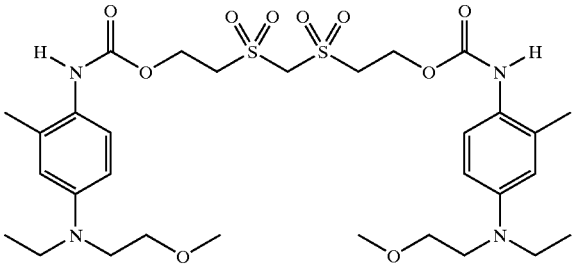

Dev-43

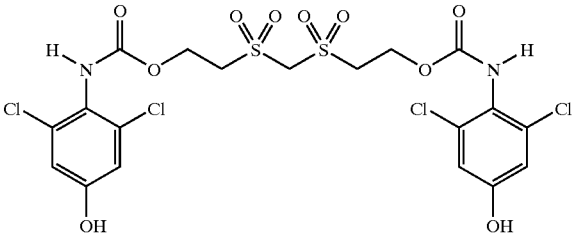

-continued

Dev-44

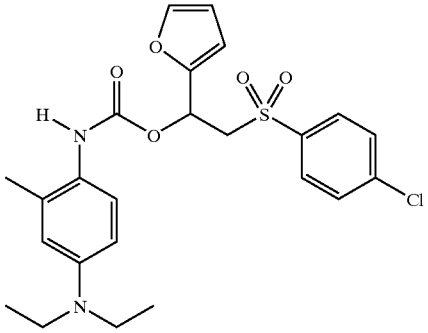

Dev-45

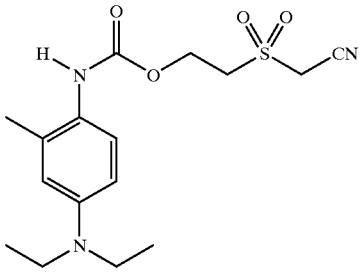

Dev-46

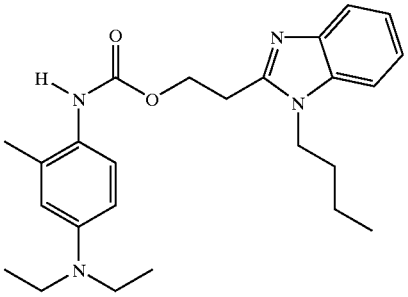

This Example illustrates the method of determining the half life ($t_{1/2}$) or thermal activity of the blocked developers according to the present invention. Except for blocked developers in which a heteroaromatic D group is present (see below), the blocked developers are test for thermal activity as follows: The blocked developer was dissolved at a concentration of ~$1.6\times10^{-5}$ M in a solution consisting of 33% (v/v) EtOH in deionized water at 60° C. and pH 7.87 and ionic strength 0.125 in the presence of Coupler-1 (0.0004 M) and $K_3Fe(CN)_6$ (0.00036 M). The reaction was followed by measurement of the magenta dye formed at 568 nm with a spectrophotometer (for example, a Hewlett-Packard 8451A Spectrophotometer or an equivalent). The reaction rate constant (k) is obtained from a fit of the following equation to the data:

$$A=A_0+A_\infty(1-e^{-kt})$$

where A is the absorbance at 568 nm at time t, and the subscripts denote time 0 and infinity (∞). The half-lives are calculated accordingly from $t_{1/2}=0.693/k$.

Coupler-1

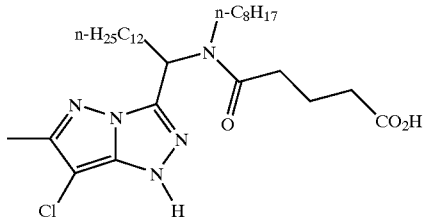

In comparison with the comparative compounds, lower onset temperatures are achieved with the inventive blocked compounds that show half-lives of 30 min or less. Preferably the half-lives are 25 min or less, more preferably 20 min or less.

To determine the half-lives of blocked developing agents of Structure I in which D is a heteroaromatic group, the blocked developer was dissolved at a concentration of ~$1.6\times10^{-5}$ M in a solution consisting dimethylsulfoxide (DMSO) solvent at 130° C. in the presence of 0.05 M of salicylanilide, which was first mixed with the DMSO solvent. The reaction kinetics was followed by high pressure liquid chromatography (HPLC) analysis of the reaction mixture, for example using a Hewlett-Packard LC 1100 System or an equivalent.

An optimum concentration of organic reducing agent in the photothermographic element varies depending upon such factors as the particular photothermographic element, desired image, processing conditions, the particular organic silver salt and the particular oxidizing agent.

The blocked developing agent is preferably incorporated in one or more of the imaging layers of the imaging element. The amount of blocked developing agent used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developing agent can be contained in a separate element that is contacted to the photographic element during processing.

After image-wise exposure of the imaging element, the blocked developing agent can be activated during processing of the imaging element by heating the imaging element during processing of the imaging element as explained above.

The photothermographic element can comprise a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, salicylanilide, benzamide, and dimethylurea.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element. After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Thermal processing is preferably carried out under ambient conditions of pressure and humidity. Conditions outside of normal atmospheric pressure and humidity are useful. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, U.S. Pat. Nos. 6,062,746 and 6,048,110 and co-pending U.S. patent application Ser. No. 09/206,586 filed Dec. 7, 1998, which are incorporated herein by reference. The use of an apparatus whereby the processor can be used to write information onto the element, information which can be used to adjust processing, scanning, and image display is also envisaged. This system is disclosed in U.S. Pat. No. 6,278,510 of Stoebe.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image-recording layer of the element. This, in some cases, reduces migration of certain addenda in the layers of the element.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, inter-layers, overcoat layers, subbing layers, antihalation layers and the like. Transparent and reflective support constructions, including subbing layers to enhance adhesion, are disclosed in Section XV of *Research Disclosure,* September 1996, Number 389, Item 38957 (hereafter referred to as ("*Research Disclosure*"). All sections referred to herein are sections of *Research Disclosure I* unless otherwise noted.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and No. 4,302,523.

Each of blue, green and red recording layer units BU, GU and RU is formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, inter-layers and protective layers on the exposure face of the support are less than 35 $\mu$m.

Any convenient selection from among conventional radiation-sensitive silver halide emulsions can be incorporated within the layer units and used to provide the spectral absorptances of the invention. Most preferably high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I,* cited above, I. Emulsion grains and their preparation. Chemical sensitization of the emulsions, which can take any conventional form, is illustrated in section IV. Chemical sensitization. Compounds useful as chemical sensitizers include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I,* cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I,* Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, herein incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-1}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of a SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant is envisioned. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure,* I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds as are known in photothermographic and conventional film systems, although their effects here may be different, such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow dye which may or may not be decolorized during thermal processing, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains thermally decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 μm mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bridegroom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gammas as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure* I, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes after the thermal development step, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure,* Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure, Vol.* 176, December 1978, Item 17643, XXIII. Image transfer systems.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element may also be a black and white image-forming material comprised, for example, of a pan-sensitized silver halide emulsion. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering,* W. Thomas, Editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications.

The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman U.S. Pat. No. 4,226,517; providing apparatus for automatic exposure control as described at Matterson et al U S. Pat. No. 4,345,835; moisture-proofing as described at Fujimura et al U.S. Pat. No. 4,766,451; providing internal and external film casings as described at Ohmura et al U.S. Pat. No. 4,751,536; providing means for recording use conditions on the film as described at Taniguchi et al U.S. Pat. No. 4,780,735; providing lens fitted cameras as described at Arai U.S. Pat. No. 4,804,987; providing film supports with superior anti-curl properties as described at Sasaki et al U.S. Pat. No. 4,827,298; providing a viewfinder as described at Ohmura et al U.S. Pat. No. 4,812,863; providing a lens of defined focal length and lens speed as described at Ushiro et al U.S. Pat. No. 4,812,866; providing multiple film containers as described at Nakayama et al U.S. Pat. No. 4,831,398 and at Ohmura et al U.S. Pat. No. 4,833,495; providing films with improved anti-friction characteristics as described at Shiba U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al U.S. Pat. No. 4,896,178; providing an externally operable member for effecting exposure as described at Mochida et al U.S. Pat. No. 4,954,857; providing film support with modified sprocket holes and means for advancing said film as described at Murakami U.S. Pat. No. 5,049,908; providing internal mirrors as described at Hara U.S. Pat. No. 5,084,719; and providing silver halide emulsions suitable for use on tightly wound spools as described at Yagi et al European Patent Application 0 466 417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow-bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the minimum usable depth is set by the focal length of the incorporated lens and by the dimensions of the incorporated film spools and cartridge. The camera will preferably have the majority of corners and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single a spherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f/16 being preferred. The lens MTF can be as low as 0.6 or less at a spatial frequency of 20 lines per millimeter (1 pm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

Cameras may contain a built-in processing capability, for example a heating element. Designs for such cameras including their use in an image capture and display system are disclosed in U.S. Pat. No. 6,302,599. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846, and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management,* Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form following the procedure described in Giorgianni et al U.S. Pat. No. 5,267,030. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those, which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner, which produces R, G, and B image-bearing signals corresponding to each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
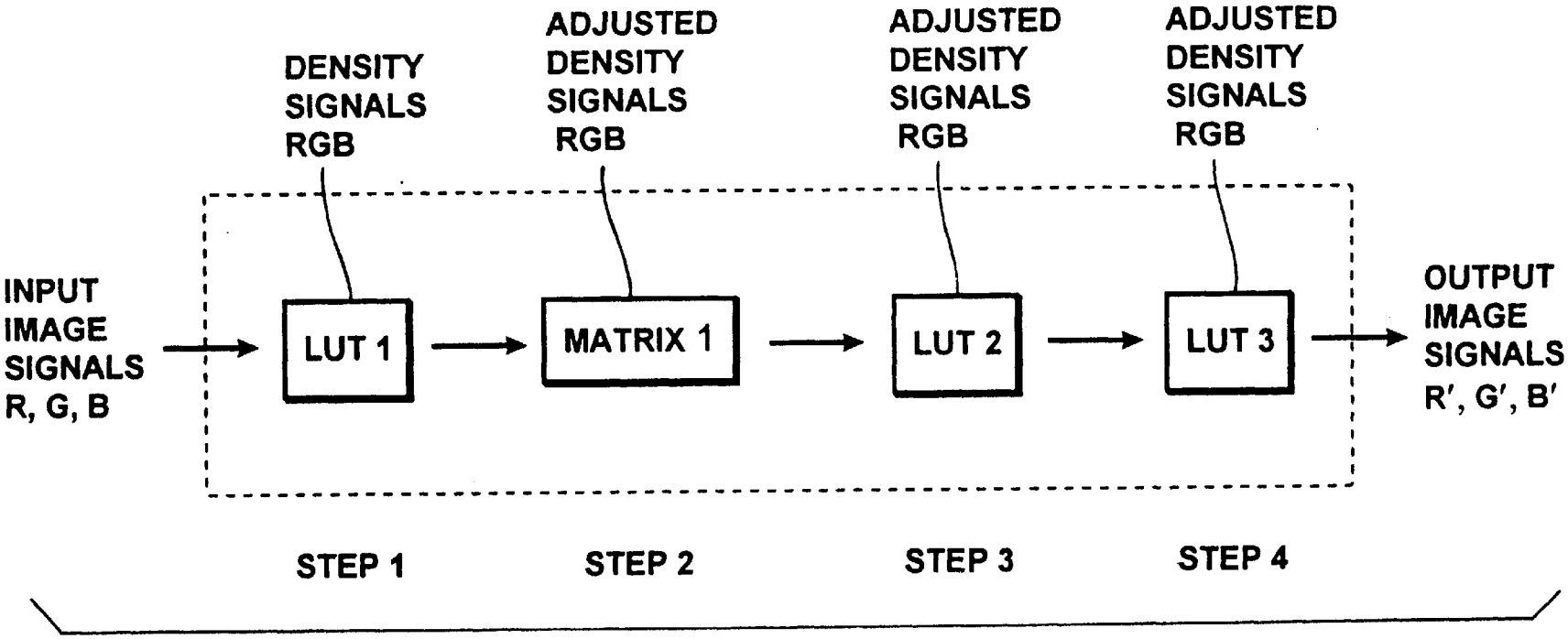
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values-or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred use, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUT's. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUT's may be developed according to the teachings of J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types-of storage and display devices as known in the art.

In yet another embodiment, the luminance and chrominance sensitization and image extraction article and method described by Arakawa et al in U.S. Pat. No. 5,962,205 can be employed. The disclosures of Arakawa et al are incorporated by reference.

The following examples are intended to illustrate, but not to limit, the invention.

EXAMPLES

Preparative Example

Preparation of Compound D12:

To a vigorously-stirred, biphasic mixture of 1-tetradecylamine (9.44 g, 44.2 mmol) in $CH_2Cl_2$ (300 mL) and potassium bicarbonate (21.8 g, 158 mmol) in $H_2O$ (200 mL) was added (dropwise) a 1.93 M solution of phosgene in toluene (30.0 mL, 57.9 mmol) at 0° C. After 30 min, the organic layer was separated and dried over $MgSO_4$. The volatile components were removed with a rotary evaporator to afford crude tetradecyl isocyanate which was immediately taken up in THF (15 mL) and added to a heterogeneous mixture of 5,6-dichlorobenzotriazole (5.94 g, 31.6 mmol) and THF (125 mL). The reaction mixture was stirred at ambient temperature for 14 h, and the volatile components were then removed with a rotary evaporator. The crude product was first purified by silica gel column chromatography (heptane: ethyl acetate=7:3) and then recrystallized from ethanol to afford 12.2 g (90%) of D12.

Preparation of Compound D13:

To a stirred suspension of 5,6-dichlorobenzotriazole (6.39 g, 34.0 mmol) in THF (125 mL) was added a solution of hexadecyl isocyanate (10.0 g, 37.4 mmol) in THF (10 mL). The reaction mixture was stirred at ambient temperature for 2 h, and the volatile components were then removed with a rotary evaporator. The crude product was first purified by silica gel column chromatography (heptane: ethyl acetate=7:3) and then recrystallized from a mixture of isopropanol and ethyl acetate (5:1) to afford 11.7 g (76%) of D13.

Preparation of Comparative Compound D-3:

To a stirred heterogeneous mixture of 5,6-dichlorobenzotriazole (26.75 g, 143 mmol) and THF (150 mL) was added five drops of dibutyltin diacetate and cyclohexyl isocyanate (18.8 mL, 147 mmol). After being stirred at room temperature for 10 hours, the homogeneous mixture was poured into water (900 mL). Precipitated solid material was isolated by filtration and recrystallized from a mixture of ethyl alcohol and ethyl acetate (3-:1) to yield 37.55 g (82%) of D-3.

Photographic Example

Processing conditions are as described in the examples. Unless otherwise stated, the silver halide was removed after development by immersion in *Kodak Flexicolor Fix* solution. In general, an increase of approximately 0.2 in the measured density would be obtained by omission of this step.

Coating Format

The inventive coating examples were prepared on a 7 mil thick poly(ethylene terephthalate) support and comprised an emulsion containing layer (contents shown below) with an overcoat layer of gelatin (0.22 g/m$^2$) and 1,1'-(methylenebis(sulfonyl))bis-ethene hardener (at 2% of the total gelatin concentration). Both layers contained spreading aids to facilitate coating.

| Component | Laydown |
|---|---|
| Silver (from emulsion E-1) | 0.54 g/m$^2$ |
| Silver (from emulsion E-2) | 0.22 g/m$^2$ |
| Silver (from emulsion E-3) | 0.16 g/m$^2$ |
| Silver (from emulsion E-4) | 0.11 g/m$^2$ |
| Silver (from silver salt SS-1) | 0.32 g/m$^2$ |
| Silver (from silver salt SS-2) | 0.32 g/m$^2$ |
| Coupler M-1 (from coupler dispersion Disp-1) | 0.54 g/m$^2$ |
| Developer Dev-1 | 0.86 g/m$^2$ |
| Salicylanilide | 0.86 g/m$^2$ |
| Blocked Inhibitor | Various, see tables |
| Lime processed gelatin | 4.3 g/m$^2$ |

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion SS-2

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 41 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsions: Silver halide emulsions were prepared by conventional means to have the following morphologies and compositions. The emulsions were spectrally sensitized to green light by addition of sensitizing dyes and then chemically sensitized for optimum performance.

E-1: A tabular emulsion with composition of 96% silver bromide and 4% silver iodide and an equivalent circular diameter of 1.2 μm and a thickness of 0.12 μm.

E-2: A tabular emulsion with composition of 98% silver bromide and 2% silver iodide and an equivalent circular diameter of 0.45 μm and a thickness of 0.06 μm.

E-3: A tabular emulsion with composition of 98% silver bromide and 2% silver iodide and an equivalent circular diameter of 0.79 μm and a thickness of 0.09 μm.

E-4: A cubic emulsion with composition of 97% silver bromide and 3% silver iodide and size of 0.16 μm.

Coupler Dispersion Disp-1

An oil based coupler dispersion was prepared containing coupler M-1 tricresyl phosphate and 2-butoxy-N,N-dibutyl-5-(1,1,3,3-tetramethylbutyl)-benzenamine, at a weight ratio of 1:0.8:0.2.

Coupler M1

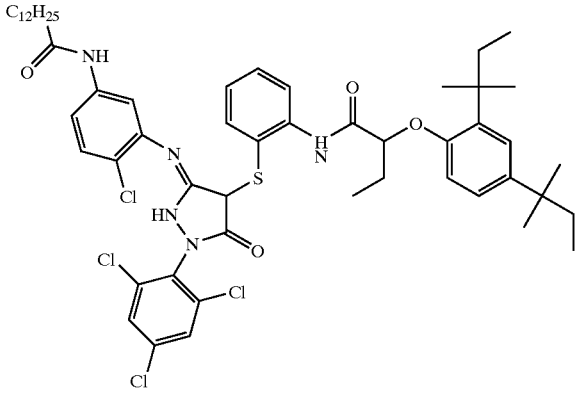

Incorporated Developer (Dev-1)

This material was ball-milled in an aqueous mixture for 4 days using Zirconia beads in the following formula: For 1 g of Incorporated developer, sodium tri-isopropylnaphthalene sulfonate (0.1 g ), water (to 10 g), and beads (25 ml) were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

Dev-1

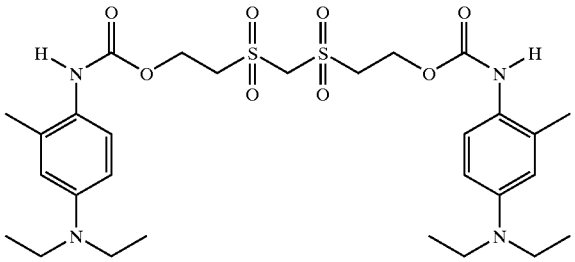

Blocked Inhibitors

These materials were ball-milled in an aqueous mixture for 4 days using Zirconia beads in the following formula. For 1 g of blocked inhibitor, sodium tri-isopropylnaphthalene sulfonate (0.1 g ), water (to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

D1

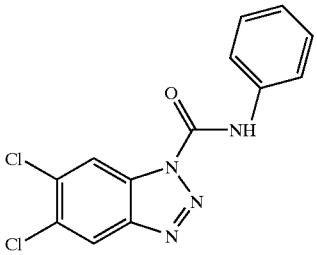

D2

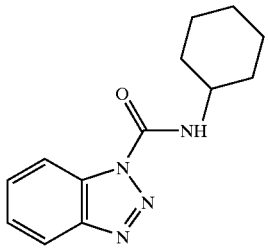

D3

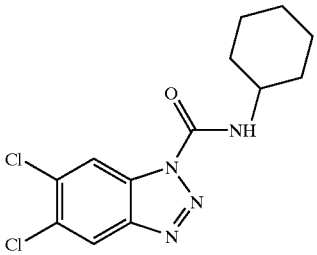

-continued

D4

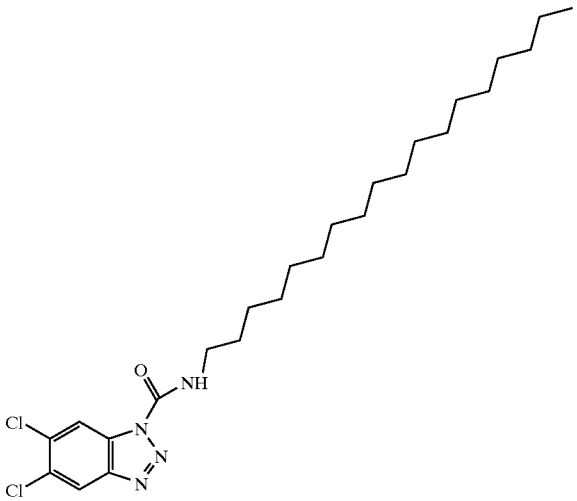

D5

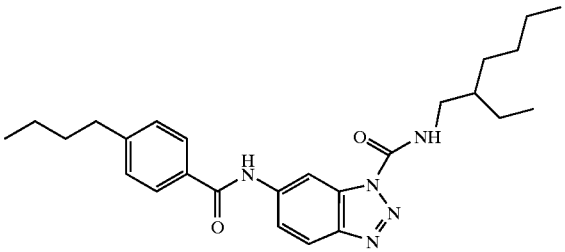

D6

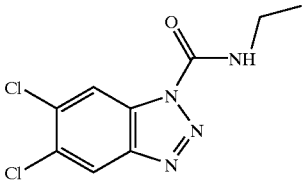

D7

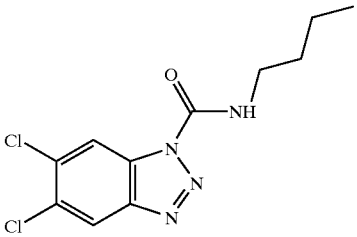

D8

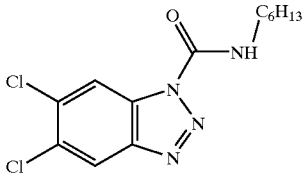

D9

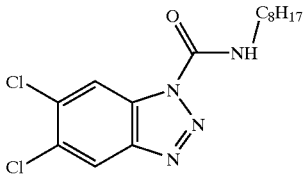

-continued

D10

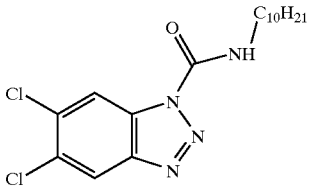

D11

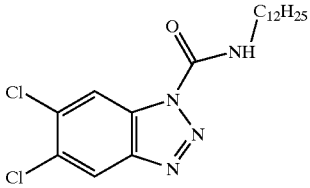

D12

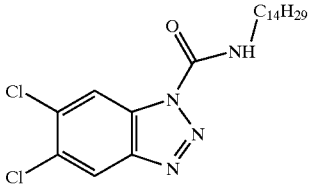

d13

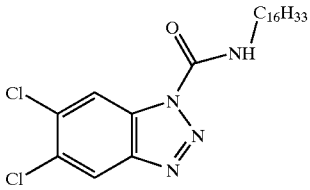

Partition Coefficients

The calculated logarithm of the octanol/water, partition coefficient, clogP, for the blocked inhibitors was estimated using the following procedure, because an exact estimate was not available from the MEDCHEM software, release 3.54 (Pomona College, California). The clogp for 1-H-benzotriazol-1yl, methyl urea was measured by experiment to be 1.77. The clogP of the blocked inhibitors were calculated, based on this urea using MEDCHEM. Note: the clog P estimate for D1 assumes alkyl and aryl ureas partition similarly.

Values for the blocked inhibitors are given in Table 1.

TABLE 1

| Blocked Inhibitor | clog P |
|---|---|
| D1 | 4.24 |
| D2 | 3.81 |
| D3 | 5.23 |
| D4 | 12.19 |
| D5 | 7.94 |
| D6 | 3.73 |
| D7 | 4.79 |
| D8 | 5.85 |
| D9 | 6.90 |
| D10 | 7.96 |
| D11 | 9.02 |
| D12 | 10.08 |
| D13 | 11.14 |

Coating Evaluation

The resulting coatings were exposed through a step wedge to a 3.04 log lux light source at 3000K filtered by Daylight 5A, 0.6 Inconel and Wratten 9 filters. The exposure time was 0.1 seconds. After exposure, the coating was thermally processed by contact with a heated platen for 20 seconds. A number of strips were processed at a variety of platen temperatures in order to check the generality of the effects that were seen. From the density readings at each step, the photographic gamma was assessed by using the maximum two-point contrast between any two measured density steps that are separated by one intervening density step, as the measure. The degree of gamma reduction is a measure of the effectiveness of the blocked inhibitor to improve latitude. The coatings were made in different coating events and are described below in the following examples:

Example 1

The coatings of inventive compounds D2, D4, and D5 shown above performed as shown in the Table 2 below, which is for strips processed at 145° C. Aqueous processing after exposure was done using a standard KODAK C-41 protocol.

TABLE 2

| Blocked Inhibitor | Quantity (mMole/m$^2$) | Gamma | % Gamma Reduction | Gamma Aqueous | % Gamma reduction Aqueous |
|---|---|---|---|---|---|
| None | | 0.63 | | 0.52 | |
| D1 | 0.35 | 0.57 | 10 | 0.40 | 23 |
| | 0.71 | 0.44 | 30 | 0.35 | 33 |
| | 1.06 | 0.39 | 38 | 0.33 | 37 |
| D2 INVENTIVE | 0.35 | 0.56 | 11 | 0.47 | 10 |
| | 0.71 | 0.44 | 30 | 0.46 | 12 |
| | 1.06 | 0.37 | 41 | 0.46 | 12 |
| D3 | 0.35 | 0.39 | 38 | 0.42 | 19 |
| | 0.71 | 0.43 | 32 | 0.41 | 21 |
| | 1.06 | 0.22 | 65 | 0.41 | 21 |
| D4 INVENTIVE | 0.35 | 0.43 | 32 | 0.48 | 8 |
| | 0.71 | 0.44 | 30 | 0.47 | 10 |
| | 1.06 | 0.29 | 54 | 0.46 | 12 |
| D5 INVENTIVE | 0.35 | 0.61 | 3 | 0.49 | 6 |
| | 0.71 | 0.51 | 19 | 0.47 | 10 |
| | 1.06 | 0.51 | 19 | 0.46 | 12 |

From the table it can be seen that D1 and D3 give large gamma reductions in both systems. This is not desirable as large gamma reductions in the aqueous developer greatly reduce the signal to be scanned. Two methods by which contrast reduction in aqueous processing solutions can be avoided are illustrated by the inventive compounds D2, D4, and D5. D2, which releases the benzotriazole inhibitor, known to be an ineffective inhibitor in aqueous systems, has little effect on gamma in the aqueous system, unlike the similar D3 which releases the stronger inhibitor 5,6-dichlorobenzotriazole. Similarly, the inhibitor released from D5 is ineffective in aqueous processing systems. D4 shows little effect in aqueous developer. In this case the molecule is sufficiently ballasted so that its solubility in the aqueous phase is too low for enough hydrolysis to occur to effect release of the 5,6-dichlorobenzotriazole in the time scale necessary for inhibition in aqueous processing. The blocked inhibitor has estimated clogP of 12.19 (greater than about 10.0)

Example 2

The coatings of compounds D4, D6–D13 shown above performed as shown in the Table 3 below, which is for strips processed at 145° C. Aqueous processing after exposure was done using a standard KODAK C-41 protocol.

TABLE 3

| Blocked Inhibitor | Quantity (mMole/m$^2$) | Gamma | % Gamma Reduction | Gamma Aqueous | % Gamma reduction Aqueous |
|---|---|---|---|---|---|
| None | | 0.84 | | 0.48 | |
| D4 INVENTIVE | 0.71 | 0.37 | 56 | 0.48 | 0 |
| D6 | 0.35 | 0.44 | 47 | 0.32 | 33 |
| | 0.71 | 0.35 | 58 | 0.33 | 31 |
| | 1.06 | 0.28 | 67 | 0.31 | 35 |
| D7 | 0.35 | 0.42 | 50 | 0.35 | 27 |
| | 1.06 | 0.27 | 68 | 0.30 | 38 |
| D8 | 0.35 | 0.51 | 39 | 0.37 | 23 |
| | 0.71 | 0.33 | 61 | 0.34 | 29 |
| | 1.06 | 0.33 | 61 | 0.34 | 29 |
| D9 | 0.35 | 0.44 | 48 | 0.37 | 23 |
| | 0.71 | 0.37 | 56 | 0.35 | 27 |
| | 1.06 | 0.31 | 63 | 0.34 | 29 |
| D10 | 0.35 | 0.43 | 49 | 0.38 | 21 |
| | 0.71 | 0.30 | 64 | 0.38 | 21 |
| | 1.06 | 0.24 | 71 | 0.37 | 23 |
| D11 | 0.35 | 0.43 | 49 | 0.42 | 13 |
| | 0.71 | 0.41 | 51 | 0.4 | 17 |
| | 1.06 | 0.26 | 69 | 0.41 | 15 |
| D12 INVENTIVE | 0.35 | 0.45 | 46 | 0.47 | 2 |
| | 0.71 | 0.38 | 55 | 0.45 | 6 |
| | 1.06 | 0.29 | 65 | 0.44 | 8 |
| D13 INVENTIVE | 0.35 | 0.5 | 40 | 0.47 | 2 |
| | 0.71 | 0.29 | 65 | 0.48 | 0 |
| | 1.06 | 0.38 | 55 | 0.47 | 2 |

From Table 3 it can be seen that (a) for a given laydown of blocked developer, as the ballast carbon chain length on the blocking group is increased (D6 through to D13 to D4), the gamma reduction in thermal development remains relatively unaffected, but the gamma reduction in aqueous development becomes less noticeable. Those blocked inhibitors with shorter ballasts give large gamma reductions in both systems. The three inventive examples, D4, D12, and D13, have clogP of greater than about 10.0 (12.19, 10.08, and 11.14) and show little or no effect in aqueous processing, because the molecules are sufficiently ballasted so that their solubility in the aqueous phase is too low for enough hydrolysis to occur to effect release of the 5,6-dichlorobenzotriazole in the time scale necessary for inhibition in aqueous processing.

The invention has been described in detail with particular reference to preferred embodiments, but it will be understood that variations and modifications can be effected within the spirit and scope of the invention.

What is claimed is:

1. An article of manufacture comprising a packaged color photographic film which photographic film has at least three light-sensitive units which have their individual sensitivities in different wavelength regions, each of the units comprising at least one light-sensitive silver halide emulsion layer, an image dye coupler, and a blocked phenylenediamine developing agent, wherein the film is enclosed by a package on which indicia indicates that the film may be processed by either a wet-chemical process or a thermal processing method; and wherein the film further comprises at least one organic silver salt and an amido compound of Formula I:

I

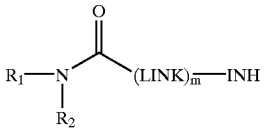

wherein INH is a development inhibitor;

LINK is a linking or timing group and m is 0, 1 or 2; and $R_1$ and $R_2$ independently is a hydrogen atom or an aliphatic, aromatic or heterocyclic group, or $R_1$ and $R_2$ together with the nitrogen to which they are attached represent the atoms necessary to form a 5- or 6-membered ring or multiple ring system, or $R_1$ and $R_2$ is independently a —C(=O)(LINK)$_m$—INH group, or are substituted with a —NR$_3$C(=O)—(LINK)$_m$—INH, with $R_3$ being defined the same as $R_1$ or $R_2$, with the proviso that only one of $R_1$ and $R_2$ can be a hydrogen atom.

2. The article of claim 1 wherein the amido compound has a clogP of greater than 10.

3. The article of claim 1 wherein the development inhibitor released by the amido compound has a pKsp less than 13.6.

4. The article of claim 1 wherein $R_1$ is a hydrogen atom.

5. The article of claim 4 wherein INH is a substituted or unsubstituted heterocyclic ring or multiple ring system containing from 1 to 4 nitrogen atoms.

6. The article of claim 5 wherein INH is a substituted or unsubstituted benzotriazole.

7. The article of claim 4 wherein $R_2$ is an alkyl group having 1 to 32 carbons or an aromatic group having 6 to 10 carbon atoms.

8. The article of claim 1 wherein the amido compound is

D2

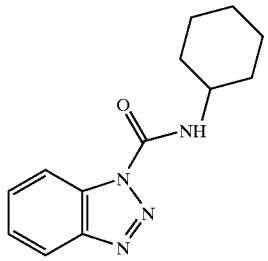

-continued

D4

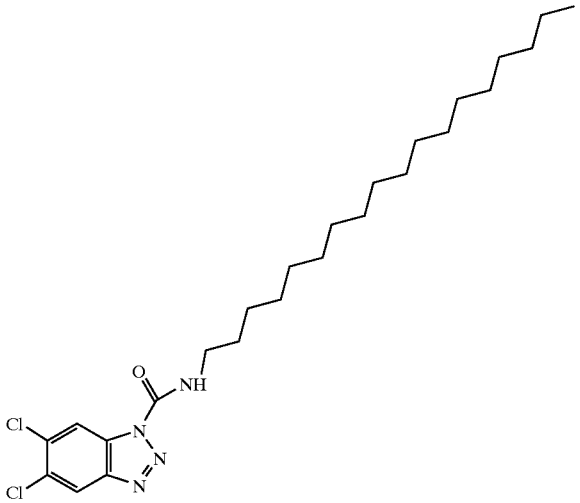

D5

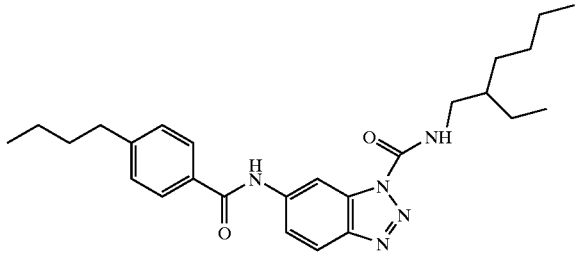

D12

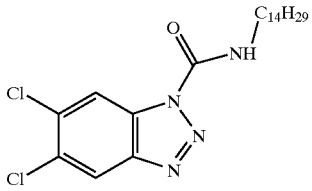

D13

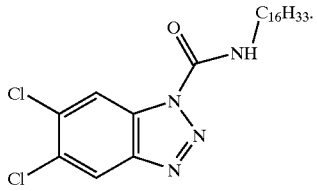

* * * * *